US005640904A

United States Patent [19]

Sato et al.

[11] Patent Number: 5,640,904

[45] Date of Patent: Jun. 24, 1997

[54] MASTER MAKING APPARATUS AND STENCIL UNIT FORMING PART THEREOF

[75] Inventors: Mitsuo Sato; Hideyuki Kagawa, both of Shibata-machi, Japan

[73] Assignee: Tohoku Ricoh Co., Ltd., Miyagi-ken, Japan

[21] Appl. No.: 305,361

[22] Filed: Sep. 13, 1994

[30] Foreign Application Priority Data

Sep. 13, 1993 [JP] Japan ..... 5-227544
Aug. 2, 1994 [JP] Japan ..... 6-181366

[51] Int. Cl.[6] ..... B41L 13/04

[52] U.S. Cl. ..... 101/128.4; 206/53; 206/409; 242/348.2

[58] Field of Search ..... 101/114, 116, 101/125, 127.1, 128, 128.1, 128.21, 128.4, 477; 206/53, 409; 242/172, 348, 348.2, 348.4, 419.4

[56] References Cited

U.S. PATENT DOCUMENTS

| | | | |
|---|---|---|---|
| 3,788,221 | 1/1974 | Borneman | 101/116 |
| 4,239,164 | 12/1980 | Barnsbee et al. | 206/409 |
| 4,628,813 | 12/1986 | Hasegawa et al. | 101/116 |
| 4,966,073 | 10/1990 | Hasegawa et al. | 101/120 |
| 5,048,416 | 9/1991 | Iijima | 101/115 |
| 5,184,549 | 2/1993 | Imamaki et al. | 101/128.21 |
| 5,207,157 | 5/1993 | Okazaki et al. | 101/128.4 |
| 5,253,581 | 10/1993 | Miki et al. | 101/125 |
| 5,375,516 | 12/1994 | Hasegawa | 101/128.4 |

FOREIGN PATENT DOCUMENTS

| | | | |
|---|---|---|---|
| 60-87094 | 5/1985 | Japan . | |
| 197275 | 9/1986 | Japan | 101/128.4 |
| 21577 | 1/1987 | Japan | 101/128.4 |
| 63-30295 | 2/1988 | Japan . | |
| 172646 | 7/1988 | Japan | 101/128.4 |
| 253942 | 10/1988 | Japan | 242/348.2 |
| 20138 | 1/1989 | Japan | 101/128.4 |
| 6-32041 | 2/1994 | Japan . | |
| 26280 | 12/1905 | United Kingdom | 206/409 |
| 2 240 513 | 8/1991 | United Kingdom . | |
| 2 267 060 | 11/1993 | United Kingdom . | |
| 2 273 908 | 7/1994 | United Kingdom . | |

*Primary Examiner*—Stephen R. Funk
*Attorney, Agent, or Firm*—Oblon, Spivak, McClelland, Maier & Neustadt, P.C.

[57] ABSTRACT

In an apparatus for making a master by perforating a stencil with a thermal head or similar heating device in accordance with image data, a stencil unit accommodating a stencil in the form of a roll is removably set. The stencil unit has a holder portion holding the roll, and a guide portion retaining the leading edge portion of the stencil paid out from the roll for thereby guiding it.

24 Claims, 20 Drawing Sheets

MASTER MAKING APPARATUS AND STENCIL UNIT FORMING PART THEREOF

BACKGROUND OF THE INVENTION

1. Field of the Invention

The present invention relates to an apparatus for making a master by perforating a stencil with a thermal head or similar heating device in accordance with image data, and a stencil unit forming part of such an apparatus.

2. Discussion of the Background

A digital thermosensitive stencil printer is a simple and convenient printing implementation known in the art. This type of printer has a thermal head on which minute heating elements are arranged in an array. While the head is held in contact with a stencil being conveyed, a current is selectively fed to the heating elements pulses in accordance with image data. As a result, the stencil is selectively perforated by heat to turn out a master. Subsequently, ink is transferred to a sheet via the perforations of the master to print out the image data.

The stencil for use with the printer of the type described may be implemented as a roll, as disclosed in Japanese Patent Laid-Open Publication No. 6-32041 by way of example. The roll is stored in an accommodating section formed in the printer, i.e., in a master making apparatus thereof. Specifically, the operator takes out a fresh stencil roll from a package, removes a tape or similar retaining member from the leading edge portion of the stencil, and then sets the roll in the accommodating section. Subsequently, the operator pulls out the leading edge portion of the stencil from the accommodating section, causes the master making apparatus to nip it, causes a conveyor to convey the stencil a predetermined amount, causes a cutter to cut off the leading edge, and then removes the cut piece of the stencil from the printer by hand.

However, the operation for mounting the stencil roll to the accommodating section of the printer described above is extremely troublesome. Moreover, since the stencil is apt to crease and bring about defective printings if handled carelessly, the mounting operation has to be performed only by an experienced person.

The stencil in the form of a roll has a laminate structure consisting of a porous substrate permeable to ink and a film of thermoplastic resin. The porous substrate is made of ordinary Japanese paper, synthetic fibers, or a mixture thereof. The problem with such a substrate is that the permeability to ink is not constant due to irregularities in the diameter, length, thickness and density of fibers constituting the substrate. Specifically, the permeability of ink is irregular when the fibers aggregate at a number of perforated portions of the film or when comparatively thick fibers traverse the perforations of the film. Further, the substrate and the thermoplastic film are joined together by adhesive. Should the distribution of the adhesive be irregular, the permeation of ink would be obstructed at the perforations of the film where a great amount of adhesive exists. Then, even if the film is successfully perforated by heat in accordance with image data, the portions of the substrate where the permeability is low cause the resulting image to be locally lost. This is particularly true when a solid image having a substantial area is printed.

Japanese Patent Laid-Open Publication No. 63-30295 discloses an approach to eliminate an occurrence that the stencil melts and adheres to the heating elements of the thermal head to result in defective perforations. The approach consists in providing a stencil storing device having a stencil guide portion, and storing a stencil roll in such a device. Even this kind of scheme is not satisfactory since the operator has to cause, by hand, the guide portion to nip the leading edge of the stencil pulled out from the roll, often creasing the stencil.

Further, Japanese Patent Laid-Open Publication No. 60-87094 teaches a stencil having a porous substrate which is implemented by a regular arrangement of fibers having the same diameter in place of Japanese paper. This kind of substrate is adhered to a thermoplastic resin film. However, the problem with this scheme is that even when a new master just perforated is wound round a drum of a printer, ink cannot reach the thermoplastic film unless it sufficiently infiltrates into the porous substrate. Hence, at the beginning of printing, a few sheets should be wasted until an acceptable image is attained. The used master is removed from the drum, collected in a preselected discharge section, and then discarded. Since the used master is discarded with a great amount of ink contained in the substrate, the running cost of ink increases.

In light of the above, there has been proposed a stencil having a thin porous substrate, and a stencil implemented substantially only by a thermoplastic resin film, i.e., lacking a porous substrate. However, while the conventional laminate type stencil is 40 μm to 50 μm thick, the stencil implemented substantially only by a thermoplastic resin film is as thin as 2 μm to 8 μm and, therefore, not sufficient in strength. Such a thin stencil is apt to adhere to the operator's hand, guide and so forth due to static electricity when it is set on a printer, again bringing about the crease problem. In addition, dust, including paper dust, deposited on the film would prevent it from being surely perforated by heat.

SUMMARY OF THE INVENTION

It is, therefore, an object of the present invention to provide a master making apparatus which allows even an inexperienced person to mount a stencil roll to an accommodating portion surely and easily, and a stencil unit forming part thereof.

It is another object of the present invention to provide a master making apparatus which, even when a stencil is implemented substantially only by a thermoplastic resin film, protects the stencil from creases and allows it to be set surely and easily, and a stencil unit forming part thereof.

In accordance with the present invention, a stencil unit for a master making apparatus and accommodating a stencil in the form of a roll comprises a holder portion holding the roll, and a guide portion retaining the leading edge portion of the stencil paid out a predetermined length from the roll for guiding the stencil.

Also, in accordance with the present invention, a master making apparatus comprises a perforating device for perforating a stencil paid out from a roll by heat in accordance with image data, a cutting device for cutting the stencil perforated by the perforating device at a predetermined length, and a stencil unit removably mounted to the apparatus and comprising a holder portion holding the roll, and a guide portion retaining a leading edge portion of the stencil paid out a predetermined length from the roll for guiding the stencil.

Further, in accordance with the present invention, a master making apparatus comprises a stencil unit removably mounted to the apparatus and comprising a holder portion holding a stencil in the form of a roll, and a guide portion formed integrally with the holder portion and nipping the stencil paid out from the roll for thereby guiding it, a thermal head for perforating the stencil paid out from the roll by heat in accordance with image data, a platen roller for conveying the stencil while pressing it against the thermal head, and a cutting device for cutting the stencil at a predetermined length.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
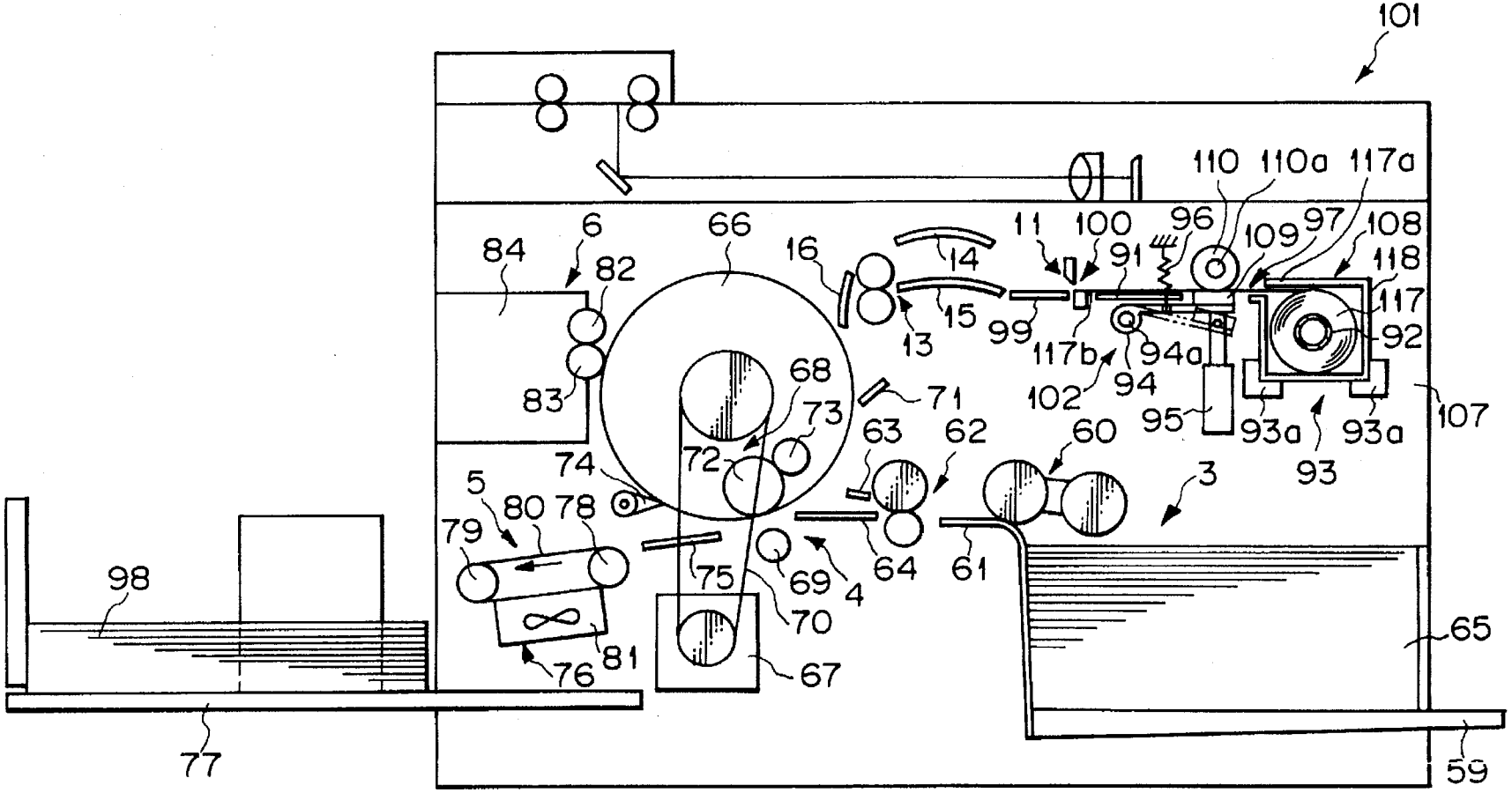
FIG. 1 is a sectional side elevation of a stencil printer incorporating a first embodiment of the master making apparatus in accordance with the present invention.

Referring to FIG. 1 of the drawings, a stencil printer is shown to which a master making apparatus embodying the present invention is applied. As shown, the printer, generally 101, is made up of a master making apparatus 102, a sheet feed section 3, a print section 4, a sheet discharge section 5, a master discharge section 6, and a housing or printer body 107. The master making apparatus 102 has a mounting portion 93 for mounting a stencil unit 108, perforating means 97 implemented by a thermal head 109 and a platen roller 110, a cutter 11, a conveyor roller pair 13, guides 14, 15, 16, 91 and 99, and a sensor 100.

Figure 2A:
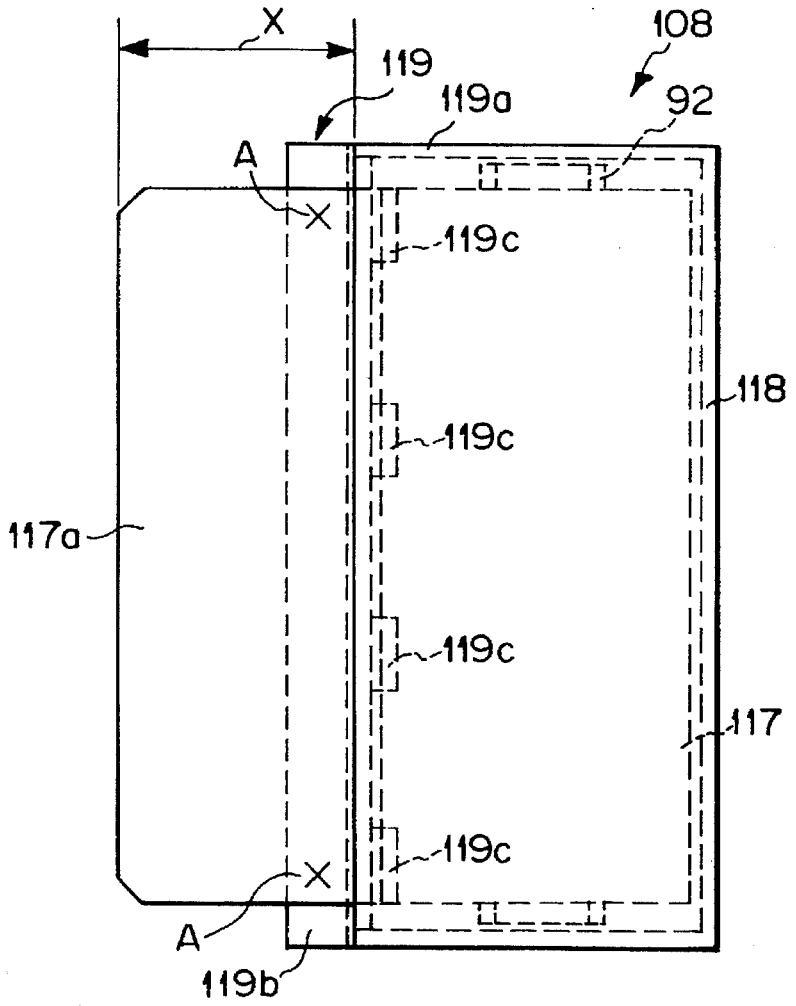
FIGS. 2A and 2B are respectively a top plan view and a sectional side elevation showing a stencil unit forming part of the first embodiment.
Figure 2B:
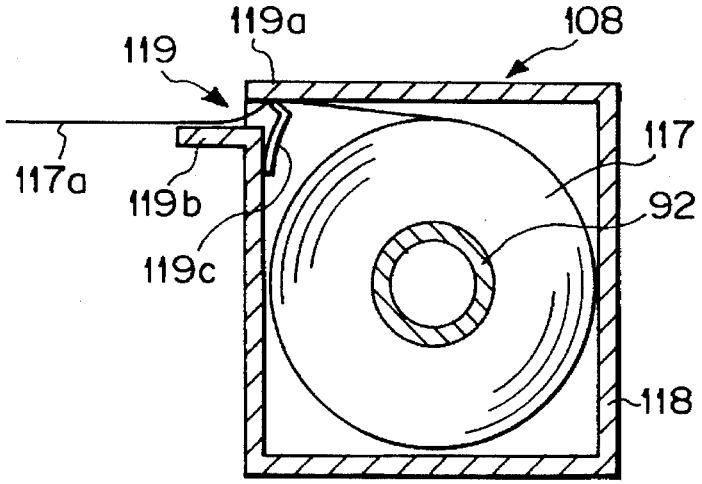

As shown in FIGS. 2A and 2B, the stencil unit 108 has a stencil roll 117 comprising a core 92 and a stencil 117*a* wound round the core 92. The stencil roll 117 is retained by a box-like holder portion 118. The stencil 117*a* paid out from the roll 117 is guided by a guide portion 119. The core 92 is a hollow cylindrical member made of paper, resin or similar material. The stencil 117*a* consists of a film of thermoplastic resin and a porous substrate adhered to the film. In the specific configuration shown in FIGS. 1, 2A and 2B, the stencil 117*a* is wound round the core 92 with the thermoplastic resin film facing inward. The holder portion 118 may be made of paper, zinc-plated steel or similar metal, or ABS resin, polyethyene or similar resin. The holder portion 118 has an inside dimension which is slightly greater than the outside diameter of a fresh stencil roll 117 in the intended direction of stencil feed, and slightly greater than the length of the core 92 in the direction perpendicular thereto.

The guide portion 119 is positioned at one corner of the holder portion 118 when the stencil unit 108 is seen from the side. The guide portion 119 is made up of an upper projection 119*a*, a lower projection 119*b*, and presser members 119*c*. The upper and lower projections 119*a* and 119*b* cooperate to guide the stencil 117*a* paid out from the roll 117 to the outside of the stencil unit 108. The presser members 119*c* are affixed to the inner periphery of the holder portion adjacent to the lower projection 119*b* and urges the stencil 117*a* against the upper projection 119*a*, thereby retaining it. The projections 119*a* and 119*b* protrude from the end of the holder portion 118, and the latter extends outward more than the former. Each of the presser member 119*c* is implemented as a thin leaf spring of resin or similar material and bent at the free end thereof. Such presser members 119*c* are affixed to the holder portion 118 at one end by, for example, adhesive or a screw. The presser members 119*c* constantly urge the stencil 117*a* against the upper projection 119*a* with a predetermined force. In the initial condition, the roll 117 is held by the holder portion 118 and guide portion 119 with the leading edge portion thereof protruding a predetermined distance X from the upper projection 119*a*.

Referring again to FIG. 1, the mounting portion 93 for the stencil unit 108 has a pair of generally L-shaped rails 93*a* which constitute a first guide portion in combination. The rails 93*a* are mounted on the housing 107 in parallel with the platen roller 110, which will be described, such that the rails 93*a* extend toward each other at one end and extend upward at the other end. The upper ends of the rails 93*a* are spaced apart a distance slightly greater than the outside width of the stencil unit 108, so that the stencil unit 108 can be smoothly moved in the direction perpendicular to the sheet surface of FIG. 1. A stop, not shown, is associated with each of the rails 93*a* in order to position the stencil unit 108 when the unit 108 is inserted into the mounting portion 93 in the above-mentioned direction. A switch, not shown, is associated with the rails 93*a*. When the stencil unit 108 is inserted into the mounting portion 93 until it abuts against the stop, the switch sends a signal to control means, not shown. The mounting portion 93 is located such that when the stencil unit 108 is mounted to the portion 93, the leading edge of the stencil 117 protruding the distance X from the unit 108 (see FIG. 2A) is brought to a position where the thermal head 109 and platen roller 110 are movable toward and away from each other.

An arm 94 is rotatably supported by a shaft 94*a* which is, in turn, supported by the housing 107. A solenoid, or moving means, 95 is disposed below the arm 94. The head 109 is mounted on the arm 94 and selectively moved by the solenoid 95 to a position indicated by a solid line or a dash-and-dots line in FIG. 1. A tension spring 96 is anchored at one end to the housing 107 and at the other end to the arm 94. When the solenoid 95 is not energized, the spring 96 urges the head 109 against the platen roller 110 with a predetermined force. The control means also controls the operation of the solenoid 95. The platen roller 110 is positioned above the head 109 and affixed to a shaft 110*a* which is journalled to the housing 107. A stepping motor, not shown, drives the platen roller 110 under the control of the control means.

The guide 91, sensor 100, cutter 11, guide 99, guides 14 and 15, conveyor roller pair 13 and guide 16 are sequentially arranged downstream of the perforating means 97 in the direction of stencil transport. The guide 91 defines a path extending from the perforating means 97 to the cutter 11. The sensor 100 is mounted on the housing 107 and sends, on sensing the leading edge of a master, or cut stencil, 117*b* being driven by the platen roller 110, a signal to the control means. The sensor 100 has the focal point thereof located at a position where the cutter 11 cuts off the master 117*b* from the webbing 117*a*. The cutter 11 may be implemented by the conventional guillotine scheme or thermic rays scheme. The conveyor roller pair 13 is rotatably supported by the housing 107 and driven in synchronism with the platen roller 110 by drive means, not shown, thereby conveying the master 117*b* toward the print section 4. A one-way clutch, not shown, is accommodated in the conveyor roller pair 13. The guides 99, 14 and 15 define, in combination, a path extending from the cutter 11 to the conveyor roller pair 13. The guide 16 forms a path extending to a clamper 71 disposed in the print section 4, as will be described specifically later.

The sheet feed section 3 is located below the master making apparatus 102 and made up of a sheet tray 59, a pick-up roller 60, a guide 61, a registration roller pair 62, and guides 63 and 64. The sheet tray 59 is positioned in a lower portion of the housing 107 and loaded with a stack of sheets 65. The pick-up roller 60 is rotatably supported by the housing 107 and disposed above the sheet tray 59. As the sheet tray 59 is elevated by elevating means, not shown, the pick-up roller 60 feeds the uppermost sheet 65 toward the registration roller pair 62. At this instant, the sheet 65 guided by the guide 61.

The registration roller pair 62 is located downstream of the pick-up roller 60 in the direction of sheet transport and rotatably supported by the housing 107. The roller pair 62 is driven by drive means, not shown, to convey the sheet 65 toward the print section 4 at a predetermined timing. The guides 63 and 64 cooperate to guide the sheet 65 toward the print section 4.

The print section 4 is positioned at the left of the sheet feed section 3 and includes a drum 66, drum drive means 67, ink supply means 68, and a presser 69. The drum 66 is rotatably supported by the side walls, not shown, of the housing 107 and implemented as a porous hollow cylinder. The drum drive means 67 rotates the drum 66 via an endless belt 70. The previously mentioned clamper 71 is provided on the drum 66 for clamping the master 117*b*. The ink supply means 68 is disposed in the drum 66 for supplying ink to the master 117*b* which is retained on the drum 66 by the clamper 71. The ink supply means 68 has an ink roller 72 and a doctor roller 73. The clamper 71 is rotatably mounted on the drum 66 and caused to open and close by opening and closing means, not shown. The ink roller 72 and doctor roller 73 are rotatably supported by the end walls, not shown, of the drum 66. While the ink roller 72 is rotated by drive transmission means, not shown, the doctor roller 73 follows the rotation of the roller 72. The presser 69, disposed below and in close proximity to the drum 66, is rotatable about its own axis and is moved toward and away from the drum 66 by exclusive means, not shown.

The sheet discharge section 5 is located below the print section 4 and includes a separator 74, a guide 75, a conveyor 76, and a tray 77. The separator 74 is rotatably supported by the side walls of the housing 107 and rotated by drive means, not shown. In this configuration, the free edge of the separator 74 is movable in close contact to and out of the surface of the drum 66. The conveyor 76, located at the left of the separator 74, has two rollers 78 and 79, an endless belt 80 passed over the rollers 78 and 79 and formed with a plurality of openings, and a suction fan 81 disposed below and between the rollers 78 and 79. The roller 78 is rotated by drive means, not shown, for driving the belt 80 in a direction indicated by an arrow in FIG. 1. The sheets 65 undergone printing, or printed sheets 98 as referred to hereinafter, are sequentially driven out of the housing 107 onto the tray 77 which is located below and at the left of the conveyor 76. Specifically, when the blank sheet 65 is pressed against the drum 66 by the presser 69, ink is transferred to the blank sheet 65. The sheet 65 undergone printing is separated from the drum 66 by the separator 74 and let fall. The resulting printed sheet 98 is guided by the guide 75 toward the conveyor 76. The conveyor 76 conveys the sheet 98 while sucking it onto the belt 80 with the suction fan 81. Finally, the sheet 98 is driven out onto the tray 77.

The master discharge section 6 is located above the sheet discharge section 5 and includes rollers 82 and 83 and a waste box 84. The rollers 82 and 83 are rotatably supported by the housing 107 and driven by drive means, not shown. The rollers 82 and 83 are rotatable clockwise and counterclockwise, respectively. The roller 83, driven by rotating means, not shown, is angularly movable into and out of contact with the drum 66. The waste box 84 is removably mounted to the housing 107.

In operation, the stencil unit 108, accommodating the roll 117 therein, is inserted into the mounting portion 93 from the front to the rear, as seen in the direction perpendicular to the sheet surface of FIG. 1. At this instant, the solenoid 95 is energized by the control means, maintaining the head 109 at the dash-and-dots line position, FIG. 1. The stencil 117*a* protruding the distance X from the guide portion 119 of the stencil unit 108 is inserted into the gap between the head 109 and the platen roller 110. As soon as the stencil unit 108 abuts against the previously mentioned stop, it presses the switch. On receiving the resulting signal from the switch, the control means deenergizes the solenoid 95. As a result, the head 109 is urged against the platen roller 110 by the tension spring 96 In this condition, the leading edge portion of the stencil 117*a* is held between the head 109 and the platen roller 110. After deenergizing the solenoid 95, the control means drives the platen roller 110 via the stepping motor. In response, the platen roller 110 conveys the stencil 117*a* along the guide 91. The sensor 100, sensed the leading edge of the stencil 117*a*, sends a signal to the control means. In response to this signal, the control means causes the platen roller 110 to stop rotating. By such a procedure, the leading edge of the stencil 117*a* is brought to a stop at the cutting position of the cutter 11, i.e., the stencil unit 108 fully set in the mounting portion 93.

As the operator turns on a start switch provided on an operation panel, not shown, the printer 101 starts on a master discharging operation. To begin with, the drum drive means 67 rotates the drum 66, carrying the previous or used master thereon, until the trailing edge of the master faces the roller 83, i.e., a master discharge position. Then, the rotating means angularly moves the roller 83 to a position where it abuts against the master wound round the drum 66. Subsequently, the drive means rotates the roller 83 counterclockwise as viewed in FIG. 1, while the drum drive means 67 rotates the drum 66 counterclockwise. As a result, the used master is separated from the drum 66 and driven into the waste box 84 by the rollers 82 and 83. This is followed by a master making operation, as follows.

After the drum drive means 67 has located the drum 66 at a master making position shown in FIG. 1, the opening and closing means opens the clamper 71 to the position also shown in FIG. I. After a document image has been read, the control means causes the platen roller 110 and conveyor roller pair 13 to start rotating in synchronism with each other. While the platen roller 110 conveys the stencil 117*a*, the head 109 cuts or perforates it by heat in accordance with image data representative of the document image. The perforated stencil, or master, 117*b* is conveyed by the conveyor roller pair 13 along the guides 91, 99, 14 and 15 and then along the guide 16 toward the clamper 71. The control means determines whether or not the leading edge of the master 117*b* has reached the clamper 71 on the basis of the number of steps of the stepping motor assigned to the platen roller 110. When the leading edge of the master 117*b* has reached the clamper 71, the control means causes the opening and closing means to close the clamper 71. As a result, the leading edge portion of the master 117*b* is retained on the drum 66 by the clamper 71. The drum drive means 67 rotates the drum 66 clockwise, as viewed in FIG. 1, in order to wrap the master 117*b* around the drum 66. On determining that the master 117*b* has been conveyed a predetermined distance on the basis of the number of steps of the stepping motor, the control means causes the drum 66, platen roller 110 and conveyor roller pair 13 to stop rotating. After the cutter 11 has cut off the master 117*b* from the webbing 117*a*, the drum 66 is rotated to wrap the entire master 117*b* therearound. This is the end of the master making procedure.

Subsequently, the pick-up roller 60 feeds the uppermost sheet 65 from the tray 59 toward the registration roller pair 62. The registration roller pair 62 drives, at a predetermined timing, the sheet 65 to between the drum 66 and the presser 69. Then, the presser 69 is angularly moved by the moving means until it abuts against the drum 66 via the sheet 65. As a result, ink fed from the ink supply means 68 deposits on the sheet 65 via the pores of the drum 66 and the perforations of the master 117*b*, whereby the image is transferred to the sheet 65. The sheet 65 with the image, i.e., a printing 98 is separated from the drum 66 by the separator 74 and driven toward the conveyor 76 along the guide 75. The conveyor 76 conveys the printing 98 while sucking it onto the belt 80 with the fan 81 and drives it out of the casing 107 onto the tray 77. If the image produced by such a trial printing is acceptable the same images are sequentially printed on the second and successive sheets 65.

After the printing operation or the stencil 117*a* has been used, the stencil unit 108 is removed from the printer 101, as follows. To begin with, the operator presses a "Unit Remove" button, not shown, provided on the operation panel. On receiving the resulting signal from the operation panel, the control means energizes the solenoid 95. As a result, the head 109 is brought to the dash-and-dots line position, FIG. 1, against the action of the tension spring 96. In this position, the stencil unit 108 can be removed from the mounting portion 93 by hand.

In the illustrative embodiment, the leading edge of the stencil 117*a* is positioned by the sensor 100, as stated above. Hence, the stencil 117*a* can be accurately positioned even if the actual length X of the stencil 117*a* protruding from the guide portion 119 is slightly different from the predetermined length. It has been customary to position the leading edge of the stencil 117*a* by pulling it beyond the cutter 11 in the direction of stencil transport and then cutting the stencil 117*a* by the cutter 11. Such a procedure, however, forces the operator to take out the leading edge portion of the stencil 117*a* cut off from the rest from the printer 101. This is extremely troublesome and obstructs efficient operation. The embodiment frees the operator from such extra work and, therefore, enhances the operation efficiency.

As shown in FIG. 2A, the stencil 117*a* paid out from the stencil unit 108 may have opposite sides thereof retained on the lower projection 119*b* by retaining means A, if desired. The retaining means A may be implemented by adhesive. When use is made of adhesive, the adhesive strength should preferably be such that the stencil 117*a* can come off and move forward when subjected to a pulling force of about 10N to 30N. This surely retains the leading edge of the stencil 17*a* and facilitates the insertion of the stencil unit 108 into the mounting portion 93. In such a modification, the presser member 119*c* is omissible.

While the head 109 has been shown and described as being movable toward and away from the platen roller 110 by the solenoid 95, it may be affixed to the casing 107 in which case the platen roller 110 will be movable.

Figure 3A:
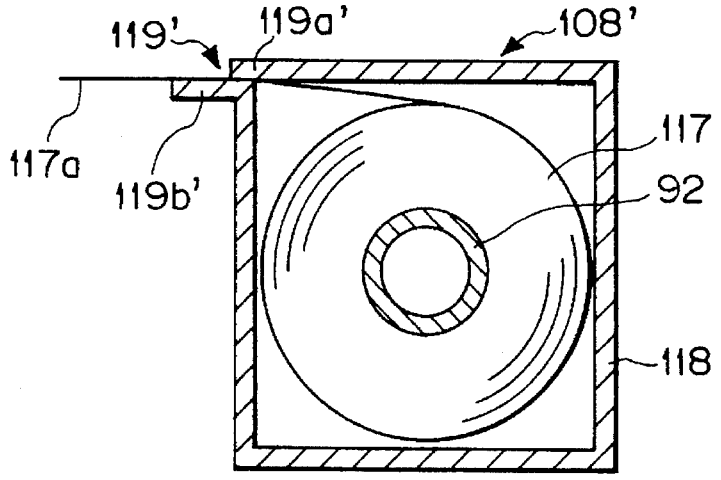
FIGS. 3A, 3B and 3C are sectional side elevations each showing a particular modified configuration of the stencil unit.
Figure 3B:
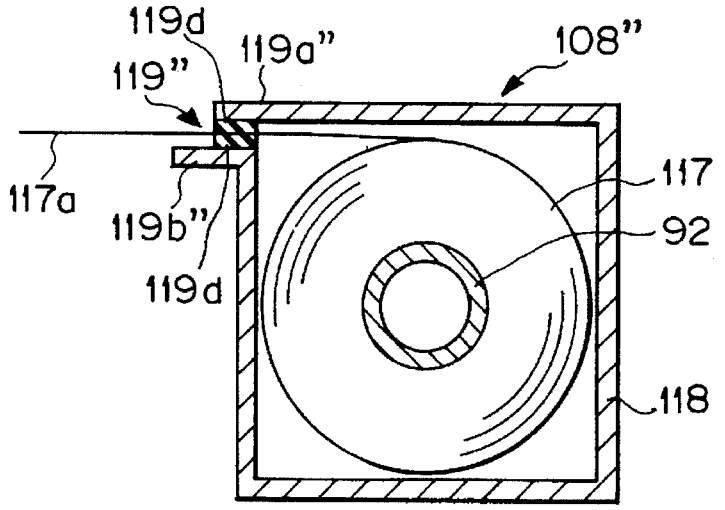
Figure 3C:
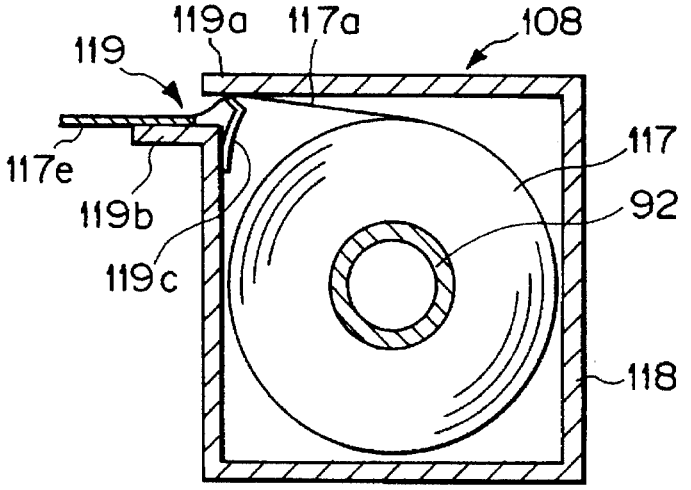

FIGS. 3A and 3B each shows another specific configuration of the stencil unit 108. As shown in FIG. 3A, a stencil unit 108' has a guide portion 119' made up of an upper projection 119*a'* and a lower projection 119*b'* which abut against each other with the intermediary of the stencil 117*a*. As shown in FIG. 3B, a stencil unit 108" has friction increasing means 119*d* between an upper projection 119*a"* and a lower projection 119*b"* which are spaced apart from each other. The friction increasing means 119*d*, made of sponge, urethane or similar material, nip the leading edge portion of the stencil 117*a*. Further, as shown in FIG. 3C, the leading edge portion of the stencil 117*a*, protruding from the guide portion 119, may be turned up or otherwise provided with a comparatively rigid tab 117*e*. The tab 117*e* will further facilitate the manipulation for mounting the stencil unit 108 to the mounting portion 93.

Figure 4:
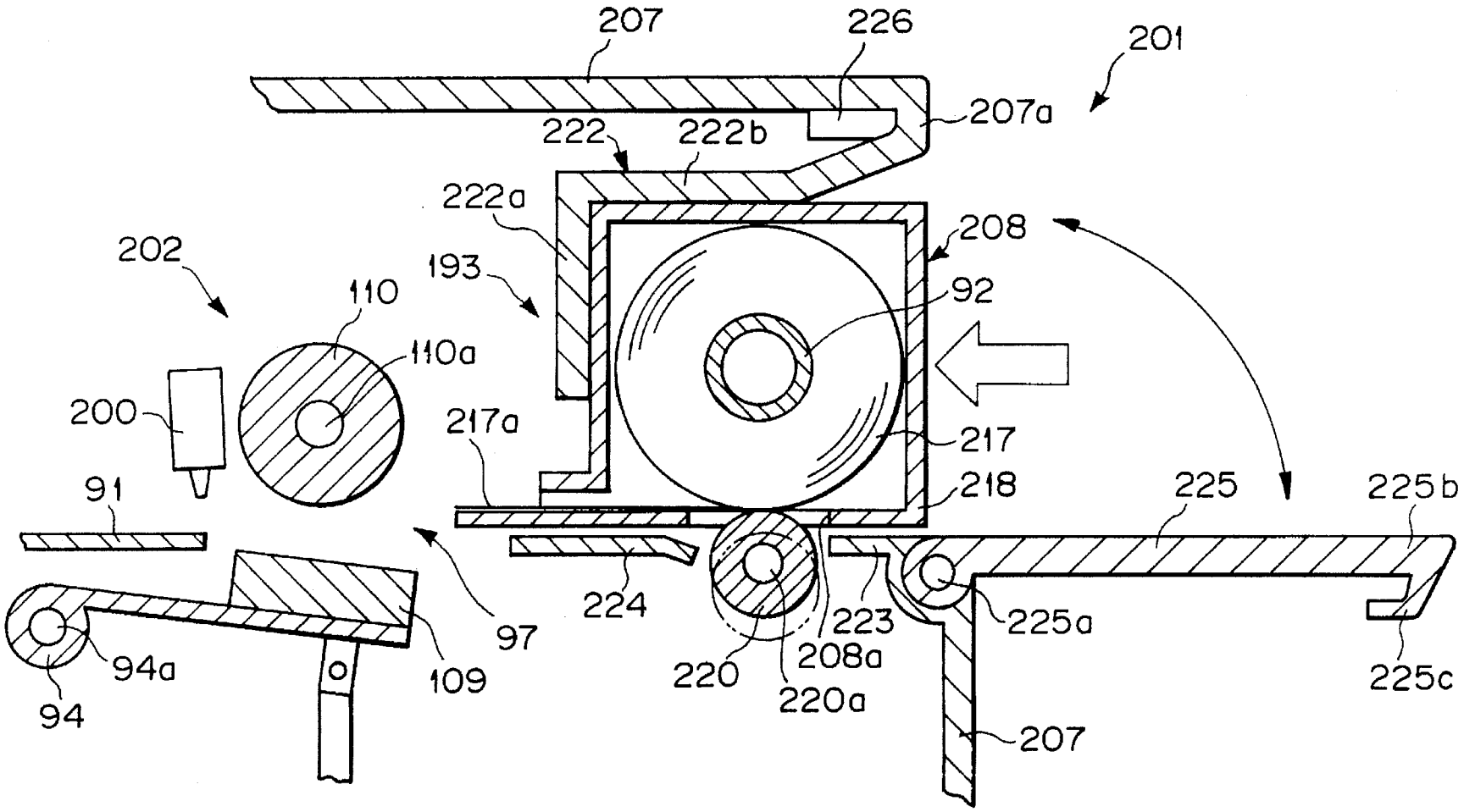
FIG. 4 is a sectional side elevation showing a second embodiment of the present invention.

Referring to FIG. 4, a second embodiment of the present invention will be described. As shown, a stencil printer 201 has a master making apparatus 202 and a housing 207 as well as the sheet feed section 3, print section 4, sheet discharge section 5, and master discharge section 6 shown in FIG. 1. The sections 3, 4, 5 and 6 are not shown in FIG. 4.

A master making apparatus, generally 202, has a stencil unit 208, a mounting portion 193, a sensor 200 and a pick-up roller 220 in addition to the perforating means 97 made up of the head 109 and platen roller 110, cutter 11, conveyor roller pair 13, guides 14–16, 91 and 99, and sensor 100. Among them, the cutter 11, conveyor roller pair 13, guides 14–16 and 99 and sensor 100 are identical with the corresponding constituents of the first embodiment and not shown.

Figure 5A:
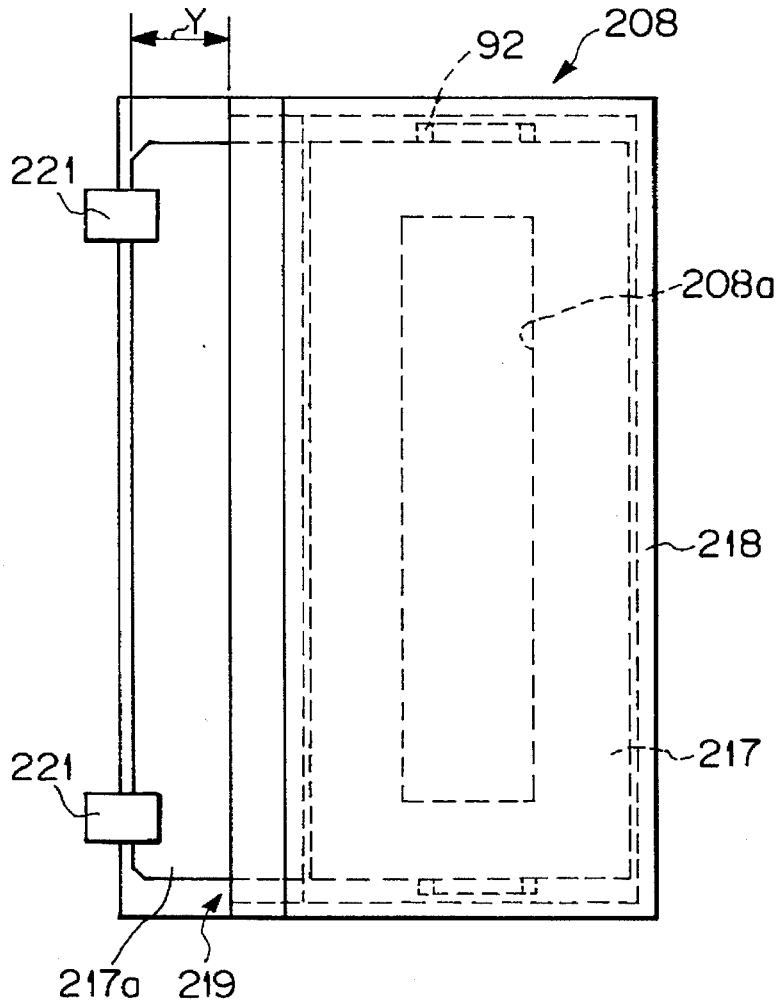
FIGS. 5A and 5B are respectively a top plan view and a sectional side elevation showing a stencil unit included in the second embodiment.
Figure 5B:
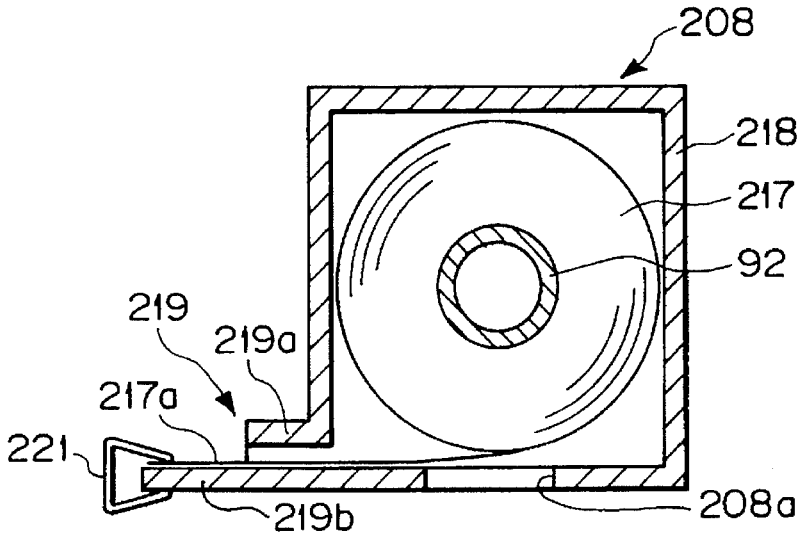

As shown in FIGS. 5A and 5B, the stencil unit 208 has a stencil roll 217 made up of the core 92 and a stencil 217*a* wound round the core 92. The roll 217 is retained by a box-like holder portion 218. The stencil 217*a* paid out from the roll 217 is guided by a guide portion 219.

The stencil 217*a* is wound round the core 92 with the thermoplastic resin film and the porous substrate thereof facing outward and inward, respectively. The holder portion 218 may be made of paper, zinc-plated steel or similar metal, or ABS resin, polyethylene or similar resin. The holder portion 218 has an inside dimension which is slightly greater than the outside diameter of a fresh stencil roll 217 in the intended direction of stencil feed, and slightly greater than the length of the core 92 in the direction perpendicular thereto. A window 208*a* is formed through the bottom of the holder portion 218 such that the pick-up roller 220 is moved into and out of the holder portion 218 therethrough. A guide portion 219 is formed on the imaginary extension of the bottom of the holder portion 218 and made up of an upper projection 219*a* and a lower projection 219*b*. The projections 219*a* and 219*b* cooperate to guide the stencil 217*a* paid out from the roll 217 to the outside of the holder portion 218. The projections 219*a* and 219*b* protrude from the end of the holder 218, and the latter extends outward more than the former. In the initial condition, the roll 217 is retained on the lower projection 219*b* by retainers 221 with the leading edge portion of the stencil 217*a* protruding a predetermined distance Y from the upper projection 219*a*.

Referring again to FIG. 4, the mounting portion 193 has an accommodating member 222, an inlet member 223, a guide 224, a cover 225, and a cover sensor 226. The accommodating member 222, formed integrally with the outside panel of the housing 207, is made up of a stop portion 222*a* and a top wall portion 222*b* which are contiguous in a form of letter "L". When the stencil unit 208 is inserted into the mounting portion 193 (outline arrow, FIG. 4), the stop portion 222*a* positions it in the front-and-rear direction. Side walls, not shown, are also contiguous with the stop portion 222*a* and top wall portion 222*b* in order to position the stencil unit 208 in the right-and-left direction. These side walls are flared at their upstream end portions, with respect to the direction of unit insertion, in order to facilitate the insertion of the stencil unit 208. Specifically, the side walls are each spaced apart from the stencil unit 208 by a clearance capable of accommodating the operator's hand.

The inlet member 223 is disposed below the accommodating member 222 and formed integrally with the outside panel of the housing 207. When the stencil unit 208 is inserted into the mounting portion 193, it is laid on the inlet member 223. The guide 224, also formed integrally with the housing 207, is located at the rear of and flush with the inlet member 223. The guide 224 and inlet member 223 are spaced apart a predetermined distance which is such that on the insertion of the stencil unit 208 into the mounting portion 193 (i.e. on the abutment of the unit 208 against the stop portion 222*a*), the unit 208 aligns with the window 208*a*. The inlet member 223, guide 224 and top wall portion 222*b* extend parallel to each other; the space delimited by them is great enough for the stencil unit 208 to move smoothly.

The cover 225 is rotatable about a shaft 225*a* at one corner of the mounting portion 193 where the inlet member 223 merges into the housing 207. The cover 225 is formed with a knob 225*c* at the free end 225*b* thereof and rotatable as indicated by a double-headed arrow in FIG. 4. A magnet, not shown, is affixed to the free end 225*b* of the cover 225. When the cover 225 is rotated upward until it magnetically adheres to the upper corner 207*a* of the housing 207, it forms part of the outer wall of the housing 207. The cover sensor 226 is disposed in the housing 207 and faces the corner 207*a* of the housing 207. When the cover 225 is dosed, i.e., when the end 225*b* of the cover 225 magnetically adheres to the corner 207*a* of the housing 207, the cover sensor 226 sends a signal to the control means.

The pick-up roller 220 is interposed between the inlet member 223 and the guide 224 and provided with a one-way clutch thereinside. The pick-up roller 220 is mounted on a shaft 220*a* journalled to a movable member, not shown, which is mounted on the housing 207. Drive means, not shown, rotates the shaft 220*a* under the control of the control means. The movable member, supporting the roller 220, is constantly biased upward by biasing means, not shown, to maintain the roller 220 in a solid line position shown in FIG. 4. However, in the event of insertion of the stencil unit 208 into the mounting portion 193, the roller 220 is urged by the bottom of the unit 208 to a dash-and-dots line position also shown in FIG. 4. If desired, the roller 220 may be selectively moved to one of the two positions by actuating means, not shown.

The sensor 200, located downstream of the master perforating means 97, senses the leading edge of the stencil 217*a* and sends an output thereof to the control means.

The stencil printer 201 having the above construction will be operated as follows. The operator grips the knob 225*c*, opens the cover 225 to the position shown in FIG. 4, removes the retainers 221 from the stencil unit 208, and then inserts the unit 208 into the mounting portion 193, as indicated by the outline arrow in FIG. 4. At this instant, the solenoid 95, FIG. 1, has been energized by the control means to hold the head 109 at the position shown in FIG. 4. The stencil unit 208 is put on the inlet member 223 first, and then inserted into the mounting portion 193. The stencil unit 208 urges the pick-up roller 220 downward from the solid line position to the dash-and-dots line position against the action of the biasing means. As the stencil unit 208 moves to the guide 224, the window 208*a* formed through the bottom of the unit 208 aligns with the pick-up roller 220. Then, the roller 220 is returned to the solid line position of FIG. 4 due to the action of the biasing means and, therefore, faces the inside of the stencil unit 208 via the window 208*a*. The roll 217 of the stencil unit 208 abuts against the roller 220 due to gravity and remains in the position shown in FIG. 4.

Subsequently, when the operator closes the cover 225, the cover sensor 226 senses the free end 225*b* of the cover 225 and sends an output thereof to the control means. In response, the control means causes the drive means, not shown, to rotate the pick-up roller 220 counterclockwise. The roll 217, driven by the pick-up roller 220, rotates clockwise with the result that the stencil 217*a* is conveyed to the left, as viewed in FIG. 4. The leading edge of the stencil 217*a* passes through the gap between the head 109 and the platen roller 110 and then reaches a position beneath the sensor 200. When the leading edge of the stencil 217*a* arrives at the position just below the sensor 200, the sensor 200 sends an output thereof to the control means. In response, the control means causes the pick-up roller 220 to stop rotating via the associated drive means and, at the same time, deenergizes the solenoid 95. As a result, the head 109 is lifted by the tension spring 96, FIG. 1, to nip the stencil 217*a* in cooperation with the platen roller 110. By such a procedure, the stencil unit 208 is fully set in the mounting portion 193.

After the stencil unit 208 has been mounted to the mounting portion 193, the start switch is pressed to execute master discharge, master making, trial printing, and printing, as stated earlier. In the master making step, when the stencil 217*a* cut or perforated by the perforating means 97 is conveyed by the platen roller 110, the pick-up roller 220 follows the rotation of the platen roller 110 due to the one-way clutch thereof. Hence, an adequate degree of tension acts on the stencil 217*a* being paid out from the roll 217, preventing the stencil 217*a* from creasing.

The perforating means 97, implemented by the head 109 and platen roller 110, may be replaced with any other suitable perforating means, e.g., one using a flash or one using a laser beam.

Figure 6:
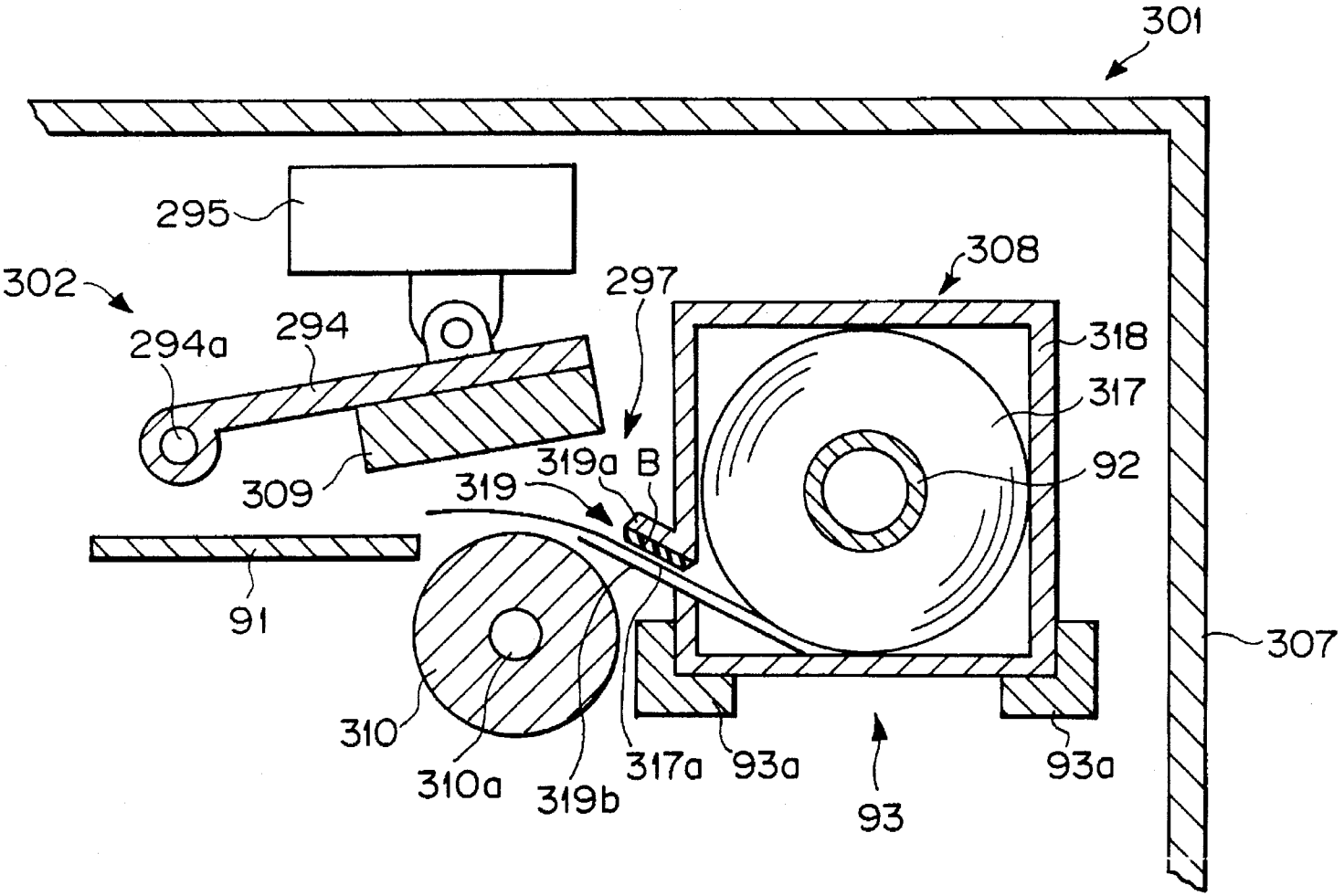
FIG. 6 is a sectional side elevation showing a third embodiment of the present invention.

FIG. 6 shows a stencil printer incorporating a third embodiment of the present invention. As shown, the printer, generally 301, has a master making apparatus 302 and a housing 307 as well as the sheet feed section 3, print section 4, sheet discharge section 5, and master discharge section 6 shown in FIG. 1. The sections 3–6 are not shown in FIG. 6. The master making apparatus 302, has a stencil unit 308 and perforating means 297 made up of a thermal head 309 and a platen roller 310, in addition to the cutter 11, conveyor roller pair 13, guides 14–16 and 99, and sensor 100. Among them, the mounting portion 93, cutter 11, conveyor roller pair 13, guides 14–16, 91 and 99 and sensor 100 are identical with the corresponding constituents of the first embodiment and not shown.

The stencil unit 308 has a stencil roll 317, a box-like holder portion 318 holding the roll 317, and a guide portion 319 retaining a stencil 317*a* paid out from the roll 317. In this embodiment, the stencil 317*a*, wound round the core 92, is implemented substantially only by a thermoplastic resin film. The holder portion 318 is made of paper, zinc-plated steel or similar metal, or ABS, polyethyene or similar resin. The holder portion 318 has an inside dimension which is slightly greater than the outside diameter of a fresh stencil roll 317 in the intended direction of stencil feed, and slightly greater than the length of the core 92 in the direction perpendicular thereto. The guide portion 319 is formed in one side wall of the holder portion 318 which is parallel to the axis of the core 92. The guide portion 319 has an upper projection 319*a* and a lower projection 319*b* and guides the stencil 317*a* paid out from the roll 317 to the outside of the stencil unit 308. The upper projection 319*a* is formed integrally with the holder portion 318. A high friction resistance member, or retaining means, B is affixed to the surface of the upper projection 319*a* which contacts the stencil 317*a*. The resistance member B has frictional resistance equal to or lower than that of the previously stated retaining means A. The lower projection 319*b* is affixed to the holder portion 318 such that it protrudes from the stencil unit 308 more than the upper projection 319*a*. The lower projection 319*b* is comprised of a 0.1 mm to 0.3 mm thick film of polyester or similar synthetic resin (e.g. MYLAR (trade name)). In the initial condition, the roll 317 is held by the holder portion 318 and guide portion 319 with the leading edge of the stencil 317*a* protruding a predetermined distance from the stencil unit 308.

An arm 294 is rotatably supported by a shaft 294*a* which is, in turn, supported by the housing 307. A solenoid, or moving means, 295 is disposed above the arm 294. The head 309 is mounted on the arm 294 and selectively moved by the solenoid 295 to a position shown in FIG. 6 or to a position where the surface of the head 309 having heating elements thereon contacts the platen roller 310. A tension spring, not shown, is anchored at one end to the housing 307 and at the other end to the arm 294. When the solenoid 295 is not energized, the tension spring urges the head 309 against the platen roller 310 with a predetermined force. Control means, not shown, controls the operation of the solenoid 295. The platen roller 310 is positioned below the head 309 and affixed to a shaft 310*a* which is journalled to the housing 307. A stepping motor, not shown, drives the platen roller 310 under the control of the control means.

In operation, the operator inserts the stencil unit 308 into the mounting portion 93 from the front to the rear in the direction perpendicular to the sheet surface of FIG. 6. At this instant, the solenoid 295 has been energized by the control means to hold the head 309 at the position shown in FIG. 6. On the insertion of the stencil unit 308, the leading edge portion of the stencil 317*a* protruding from the guide portion 319 is inserted into the gap between the head 309 and the platen roller 310. As soon as the stencil unit 308 abuts against the stop, disposed in the mounting portion 93, it presses the switch. In response to the resulting signal from the switch, the control means deenergizes the solenoid 295. As a result, the head 309 is urged toward the platen roller 310 due to the action of the tension spring, so that the leading edge portion of the stencil 317*a* is nipped by the head 309 and platen roller 310. Thereafter, the control means causes the platen roller 310 to rotate via the stepping motor. The platen roller 310, therefore, conveys the stencil 317*a* along the guide 91. On sensing the leading edge of the stencil 317*a*, the sensor 100, FIG. 1, sends an output thereof to the control means. In response, the control means causes the platen roller 310 to stop rotating. By such a procedure, the leading edge of the stencil 317*a* is positioned at the cutter 11, and the stencil unit 308 is fully set in the mounting portion 93. Thereafter, the start switch is pressed to execute the previously stated master discharging, master making, trial printing, and printing steps.

The stencil 317*a*, implemented substantially only by a thermoplastic resin film, may be replaced with a conventional stencil having a laminate structure, if desired.

Figure 7:
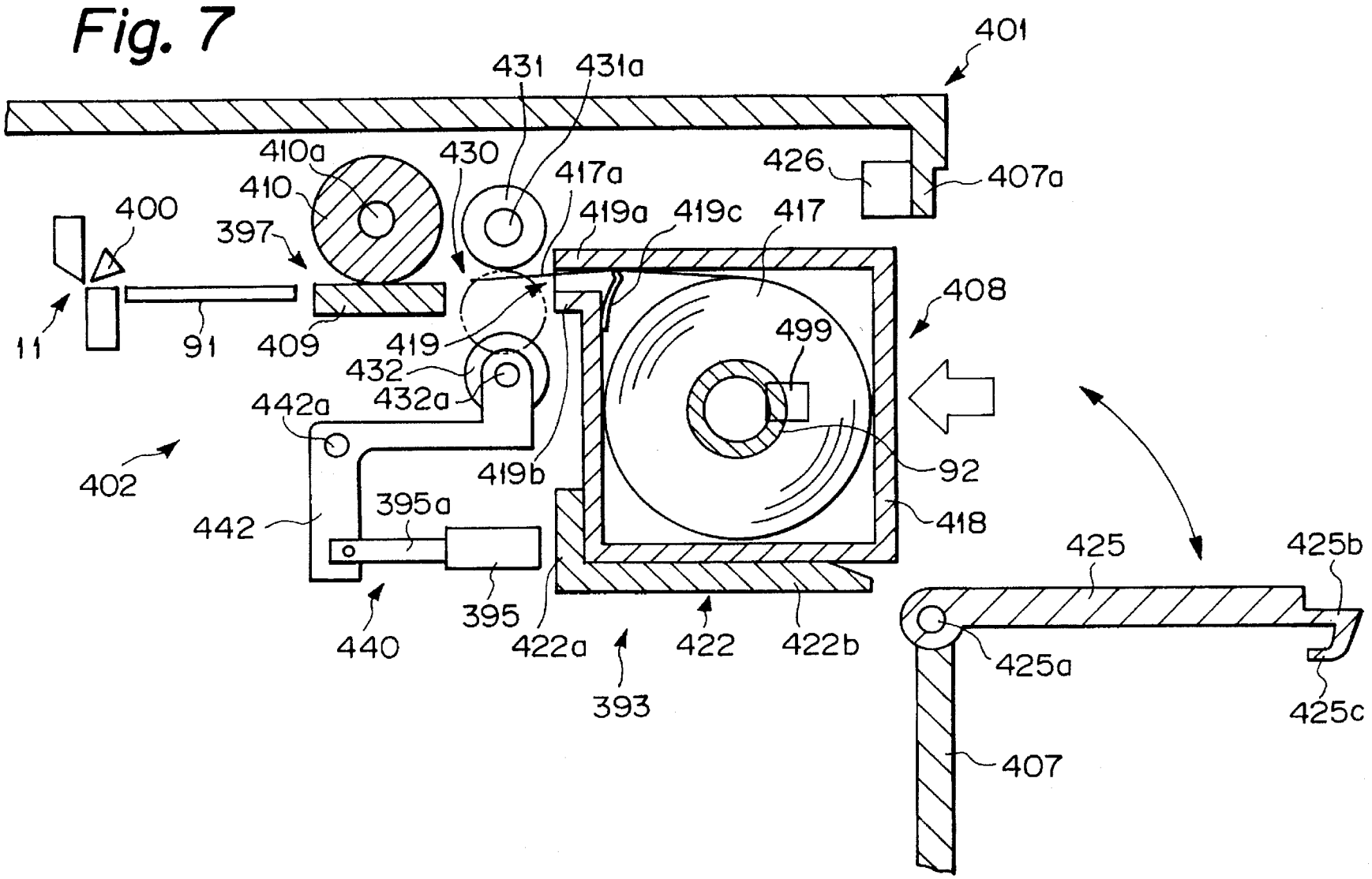
FIG. 7 is a sectional side elevation showing a fourth embodiment of the present invention.

FIG. 7 shows a stencil printer incorporating a fourth embodiment of the present invention. As shown, the printer, generally 401, has a master making apparatus 402 and a housing 407 as well as the sheet feed section 3, print section 4, sheet discharge section 5, and master discharge section 6 shown in FIG. 1. The sections 3–6 are not shown in FIG. 7. The master making apparatus 402, has a stencil unit 408, a mounting portion 393, perforating means 397 made up of a thermal head 409 and a platen roller 410, a sensor 400, a pay-out roller pair 430 and pay-out roller moving means 440 in addition to the cutter 11, conveyor roller pair 13, and guides 14–16, 91 and 99. Among them, the conveyor roller pair 13 and guides 14–16 and 99 are identical with the corresponding constituents of the first embodiment and not shown.

The stencil unit 408 has a stencil roll 417, a box-like holder portion 418 holding the roll 417, and a guide portion 419 retaining a stencil 417*a* paid out from the roll 417. The stencil 417*a*, like the stencil 117, is wound round the core 92 with the thermoplastic resin film and porous substrate thereof facing inward and outward, respectively. The holder portion 418 is made of paper, zinc-plated steel or similar metal, or ABS, polyethyrene or similar resin. The holder portion 418 has an inside dimension which is slightly greater than the outside diameter of a fresh stencil roll 417 in the intended direction of stencil feed, and slightly greater than the length of the core 92 in the direction perpendicular thereto. The guide portion 419 is positioned at one corner of the holder portion 418 when the stencil unit 408 is seen from the side. The guide portion 419 is made up of an upper projection 419*a*, a lower projection 419*b*, and a presser member 419*c*. The upper projection 419*a* and lower projection 419*b* cooperate to guide the stencil 417*a* paid out from the roll 417 to the outside of the stencil unit 408. The presser member 419*c* is affixed to the inner periphery of the holder portion 418 adjacent to the lower projection 419*b* and urges the stencil 417*a* against the upper projection 419*a*, thereby retaining the stencil 117*a*. The projections 419*a* and 419*b* protrude the same distance, as measured from a corner of the holder portion 418. The presser member 419*c* is implemented as a thin leaf spring of resin or similar material and bent at the free end thereof. A plurality of such presser members 419*c* are affixed to the holder portion 418 at one end by, for example, adhesive or screw. The presser members 419*c* constantly urge the stencil 417*a* against the upper projection 419*a* with a predetermined force. In the initial condition, the roll 417, like the roll 117, is held by the holder portion 418 and guide portion 419 with the leading edge portion thereof protruding the predetermined distance X, FIG. 2A, from the stencil unit 408. A braking unit 499 for breaking the stencil 417*a* is provided.

The mounting portion 393 is provided in the housing 407 and comprised of an accommodating member, or second guide portion, 422, a cover 425, and a cover sensor 426. The accommodating member 422 is formed integrally with the housing 407 and has a stop 422*a* and a rack 422*b* which are contiguous in a form of letter "L". When the stencil unit 408 is inserted into the mounting portion 393 (outline arrow, FIG. 7), the stop 422*a* positions it in the front-and-rear direction. Side walls, not shown, are formed integrally with the stop 422*a* and rack 422*b* in order to position the stencil unit 408 in the right-and-left direction.

A cover 425 forms part of the outside panel of the housing 407 and allows the stencil unit 408 to be removably mounted to the mounting portion 393. The cover 425 is rotatable about a shaft 425*a*, as indicated by a double-headed arrow in FIG. 7, and formed with a knob 425*c* at the free end 425*b* thereof. A magnet, not shown, is affixed to the free end 425*b* of the cover 425. When the cover 425 is rotated upward until it magnetically adheres to the upper corner 407*a* of the housing 407, it forms part of the outer wall of the housing 407. The cover sensor 426 is disposed in the housing 407 and faces the corner 407*a* of the housing 407. When the cover 425 is closed, i.e., when the end 425*b* of the cover 425 magnetically adheres to the corner 407*a* of the housing 407, the cover sensor 426 sends a signal to the control means.

The pay-out roller pair 430 and means 440 for moving it are located at the left (rear in the printer) of the mounting portion 393. The roller pair 430 is made up of a drive roller 431 and a driven roller 432. The drive roller 431 is mounted on a shaft 431*a* journalled to the housing 407, while the driven roller 432 is mounted on a shaft 432*a*. The drive roller 431 is rotated by drive means, not shown. The shaft 432*a* is angularly movably supported by the moving means 440, which will be described later. The drive means for rotating the drive roller 431 is controlled by the control means.

The moving means 440 is implemented by a solenoid 395 and generally Z-shaped arms 442 (only one is visible). The solenoid 395 is mounted on the housing 407 and controlled by the control means. The arms 442 are each affixed at the intermediate portion thereof to a shaft 442*a* which is journalled to the housing 407. The above-mentioned shaft 432*a* is rotatably supported by one end of the arms 442. The solenoid 395 has a plunger 395*a* affixed to the other end of the arm 442. While the solenoid 395 is not energized, the driven roller 432 is held at a fourth position indicated by a solid line in FIG. 7; the roller 432 is spaced apart from the drive roller 431. On the energization of the solenoid 395, the driven roller 432 is brought to a third position indicated by a dash-and-dots line in FIG. 7; the roller 432 contacts the drive roller 431.

The perforating means 397, made up of the head 409 and platen roller 410, is located at the left (rear in the printer) of the pay-out roller pair 430 and moving means 440. The head 409 is mounted on the housing 407 with the surface thereof provided with heating elements facing upward. The platen roller 410 is disposed above the head 409 and mounted on a shaft 410*a* which is journalled to the housing 407. The stepping motor, not shown, rotates the platen roller 410 under the control of the control means. The platen roller 410 is constantly biased downward by biasing means, not shown, and urged against the head 409 thereby.

The sensor 400 is positioned at the left (rear in the printer) of the perforating means 397 and mounted on the housing 407. When the sensor 400 senses the leading edge of the stencil 417*a* being conveyed by the platen roller 410, it sends an output thereof to the control means. The sensor 400 is positioned such that the focal point thereof coincides with the cutting position of the cutter 11.

In operation, the operator holds the knob 425*c* of the cover 425, opens the cover 425 to the position shown in FIG. 7, and then inserts the stencil unit 408 into the mounting portion 393. At this instant, the solenoid 395 has been deenergized by the control means, holding the driven roller 432 at the solid line position shown in FIG. 7. The stencil unit 408 is put on the rack 422*b* first, and then inserted into the mounting portion 393 until it abuts against the stop 422*a*.

When the operator closes the cover 425, the cover sensor 426 senses the free end 425*b* of the cover 425 and sends an output thereof to the control means. In response, the control means energizes the solenoid 395 with the result that the driven roller 432 is brought to the third position indicated by the dash-and-dots line in FIG. 7. At the same time, the control means rotates the drive roller 431 and platen roller 410 clockwise via the drive means and stepping motor associated therewith. The pay-out roller pair 430 in rotation conveys the leading edge portion of the stencil 417*a* to the left, as viewed in FIG. 7, and the leading edge of the stencil 417*a* arrives at a position beneath the sensor 400. On sensing the leading edge of the stencil 417*a*, the sensor 400 sends an output thereof to the control means. In response, the control means causes the drive roller 431 and platen roller 410 to stop rotating via the associated drive means and stepping motor and deenergizes the solenoid 395. Consequently, the driven roller 432 is angularly moved downward to the third position indicated by the solid line in FIG. 7. By the procedure described above, the stencil unit 408 is fully set in the mounting portion 393. This is also followed by the master discharging, master making, trial printing, and printing steps.

Again, the perforating means 397, implemented by the head 409 and platen roller 410, may be replaced with any other suitable perforating means, e.g., one using a flash or one using a laser beam.

Figure 8:
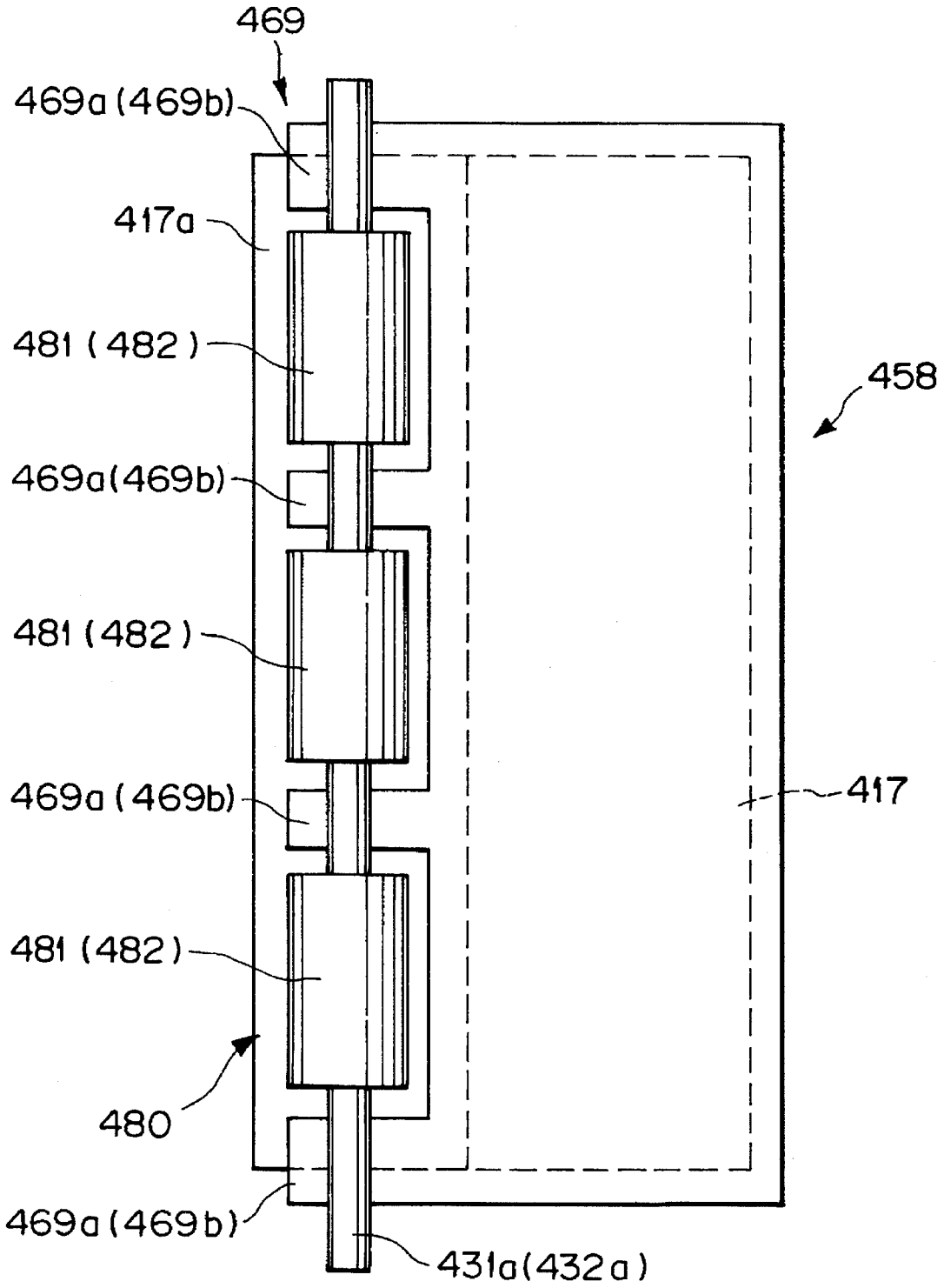
FIG. 8 is a view showing a stencil unit and a pay-out roller pair included in the fourth embodiment.

FIG. 8 shows a modification of the fourth embodiment described above. As shown, the pay-out roller pair 430 is replaced with a pay-out roller pair 480 having a plurality of drive roller elements 481 and a plurality of driven roller elements 482. Also, a stencil unit 458 has, in place of the previously stated guide portion 419, a guide portion 469 made up of upper projections 469*a* and lower projections 469*b*. In this configuration, when the stencil unit 458 is mounted to the mounting portion 393, the projections 469*a* and 469*b* protrude into the spaces between the drive rollers 481 and the driven rollers 482, thereby retaining the leading edge portion of the stencil 417*a* stably.

In another modification of the fourth embodiment, braking means may be provided on the inner periphery of the holder portion included in the stencil unit 108, 208, 308, 408 or 458. The braking means brakes the the stencil roll in rotation when the stencil is paid out from the roll. This kind of arrangement will prevent the stencil from creasing during master making or transport due to a tension acting between the roll and the leading edge of the stencil.

While the first, second and fourth embodiments and the modifications described above use a stencil made up of a thermoplastic resin film and a porous substrate, use may be made of a stencil implemented substantially only by a thermoplastic resin film. The words "stencil implemented substantially only by a thermoplastic resin film" refer to a stencil consisting only of a thermoplastic resin film, a stencil in the form of a thermoplastic resin film containing a small amount of antistatic agent or similar substance, or a stencil having one or more overcoat layers or similar thin films on at least one of opposite major surfaces of a thermoplastic resin film.

Figure 9:
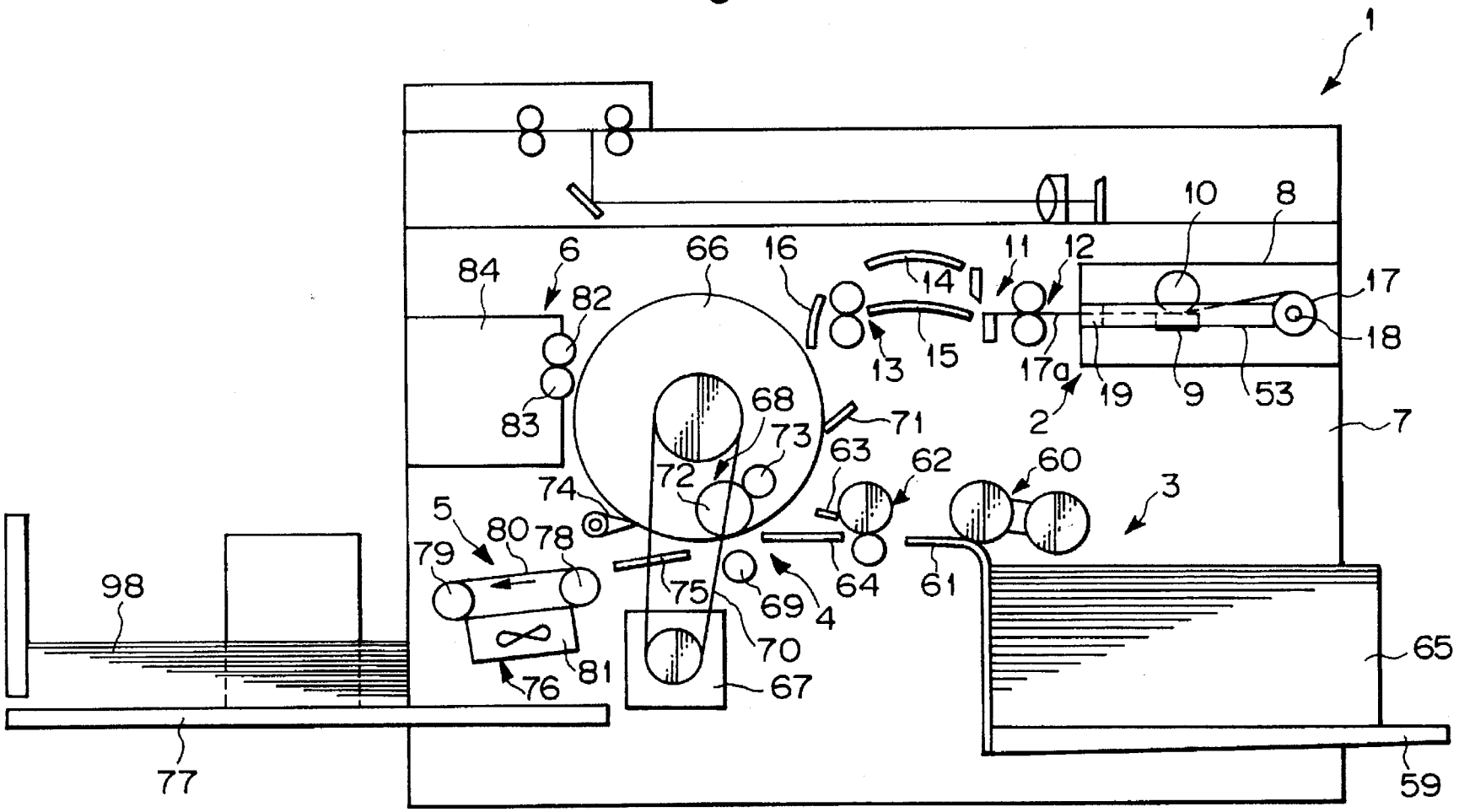
FIG. 9 is a sectional side elevation showing a fifth embodiment of the present invention.

Referring to FIG. 9, a stencil printer with a fifth embodiment of the present invention is shown and generally designated by the reference numeral 1. As shown, the printer 1 has a master making apparatus 2 and a housing 7 in addition to the sheet feed section 3, print section 4, sheet discharge section 5, and master discharge section 6. The sections 3–6 are identical with the sections 3–6 of the first embodiment and will not be described in order to avoid redundancy. The master making apparatus 2 has a stencil unit 8, a thermal head 9 and a platen roller 10 as well as the cutter 11, conveyor roller pair 13, and guides 14, 15 and 16 which are identical with those of the first embodiment.

Figure 10:
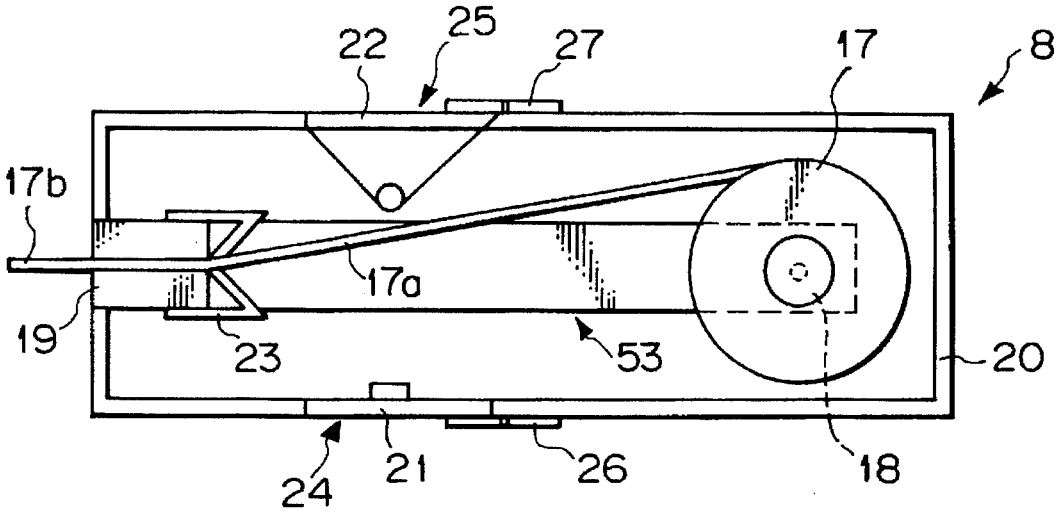
FIG. 10 is a sectional side elevation of a stencil unit included in the fifth embodiment.
Figure 11:
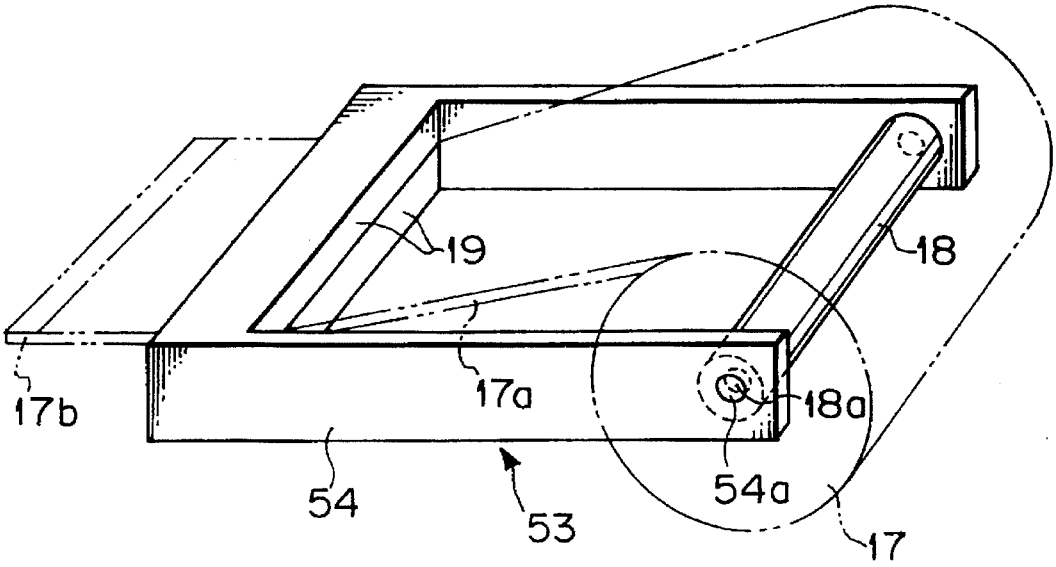
FIGS. 11 and 12 are perspective views of the stencil unit of the fifth embodiment.

As shown in FIG. 10, the stencil unit 8 has a unit body 53 made up of a holder portion 18 holding a stencil roll 17 and a guide portion 19 nipping a stencil 17*a* paid out from the roll 17, a cover 20, lids 21 and 22, and a check member 23. As shown in FIG. 11, the unit body 53 has a frame 54 in addition to the holder portion 18 and guide portion 19. The holder portion 18 has projections 18*a* at opposite ends thereof. A spring, shown, is yieldably accommodated in the holder not portion 18 and constantly urges the projections 18*a* outward. The projections 18*a* are respectively received in holes 54*a* formed in the frame 54. The holder portion 18 has an outside diameter smaller than the inside diameter of the core of the roll 17 and supports the roll 17 such that it is rotatable relative to the frame 54. The holder portion 18 is configured such that when it is pushed upward or downward, the projections 18*a* retract into the portion 18 out of the holes 54*a* of the frame 54. This facilitates the replacement of the roll 17.

The guide portion 19 nips the stencil 17*a* paid out from the roll 17 from both sides in the up-and-down direction, thereby protecting the stencil 17*a* from creases. The guide portion 19 may be implemented as a brush or a block of foam styrol by way of example. The leading edge portion of the stencil 17*a*, protruding from the guide portion 19, may be turned up or otherwise provided with a comparatively rigid tab 17*b*. Then, the stencil unit 8 will be easily inserted into and set on the printer 1.

Figure 12:
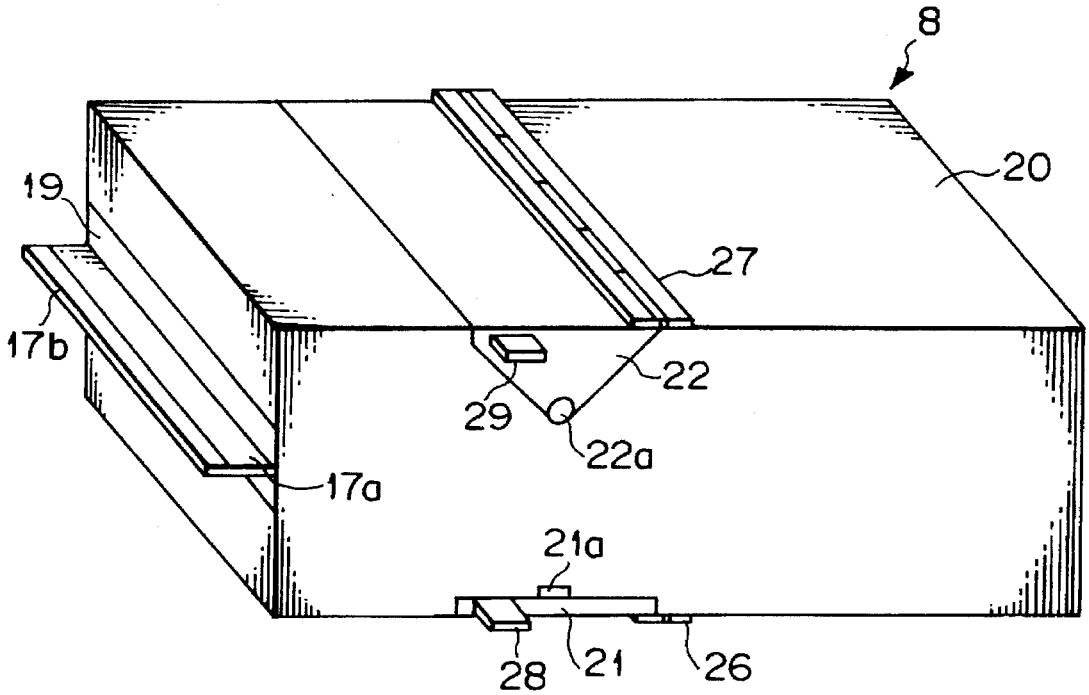

The cover 20 is removably mounted to the unit body 53 in such a manner as to cover the roll 17 and unit body 53. Openings 24 and 25 are respectively formed through the bottom and the top of the cover 20, so that the head 9 and platen roller 10 may move into and out of the stencil unit 8. The lids 21 and 22 are connected to the cover 20 by hinges 26 and 27, respectively. A torsion spring, not shown, is associated with each of the hinges 26 and 27 for constantly biasing the lid 21 or 22 in the closing direction. As shown in FIG. 12, the lid 21 has a lug 28 at opposite sides thereof while the cover 20 is formed with a hole 21*a* through which a wiring extending from the head 9 is passed. The lid 22 is formed with a hole 22*a* through which the shaft of the platen roller 10 is passed, and lugs 29. The cover 20 may be made of paper, zinc-plated steel or similar metal, or ABS, polyethylene or similar resin. Preferably, the cover 20 should be made of a reusable material. Of course, the configuration of the cover 20 shown in FIG. 12 is only illustrative and should preferably be easy to carry and stack.

Figure 13:
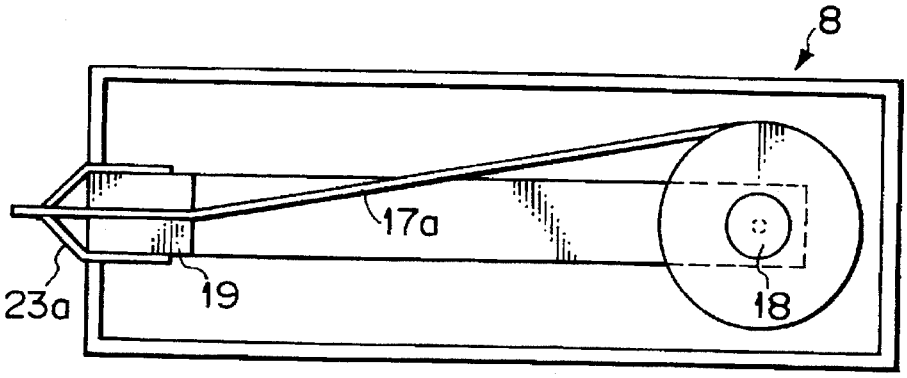
FIGS. 13 and 14 are sectional side elevations of the stencil unit of the fifth embodiment.
Figure 14:
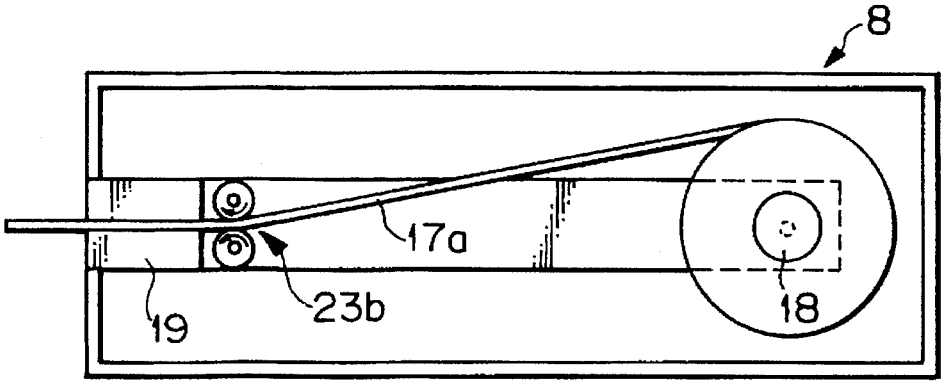

The check member 23 is positioned downstream of the guide portion 19 in the direction of stencil transport and prevents the stencil 17*a* from retracting into the stencil unit 8 from the portion 19. FIGS. 13 and 14 each shows a particular form of the check member 23. In FIG. 13, a check member 23*a* is located downstream of the guide portion 19 in the direction of stencil transport. In FIG. 14, a check member 23*b* is implemented as a pair of rollers which are allowed to rotate in one direction by a one-way clutch. The check member 23*a* or 23*b* may be comprised of a brush or a MYLAR sheet.

Figure 15:
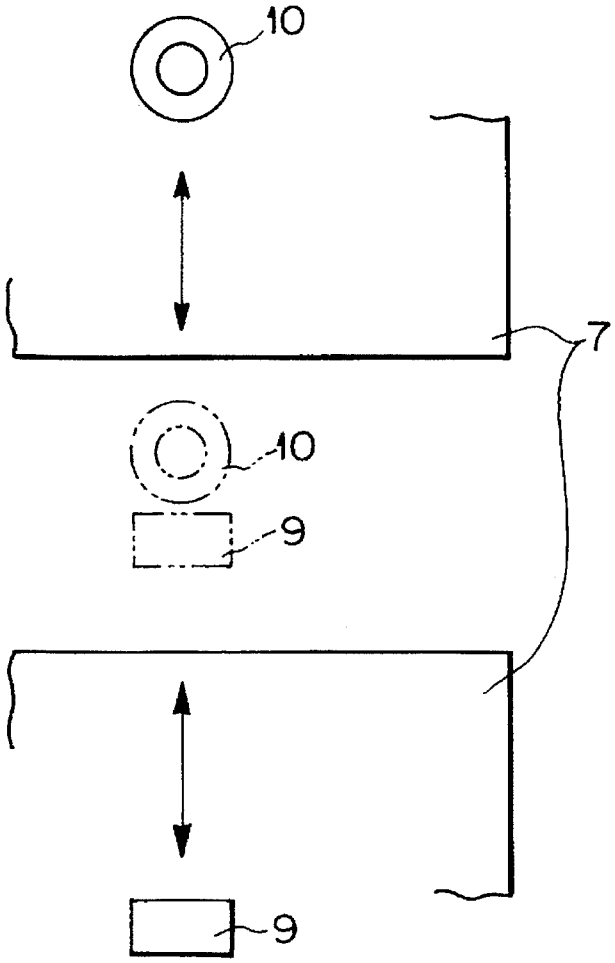
FIG. 15 is a side elevation demonstrating the operation of the fifth embodiment.

As shown in FIG. 15, the head 9 and platen roller 10 are disposed in the housing 7. The head 9 and platen roller 10 are each supported by moving means 30, FIGS. 16 and 17, in such a manner as to be movable to a fifth position indicated by a solid line or to a sixth position indicated by a dash-and-dots line. In the sixth position, the head 9 and platen roller 10 are pressed against each other with the intermediary of the stencil 17*a*.

Figure 16:
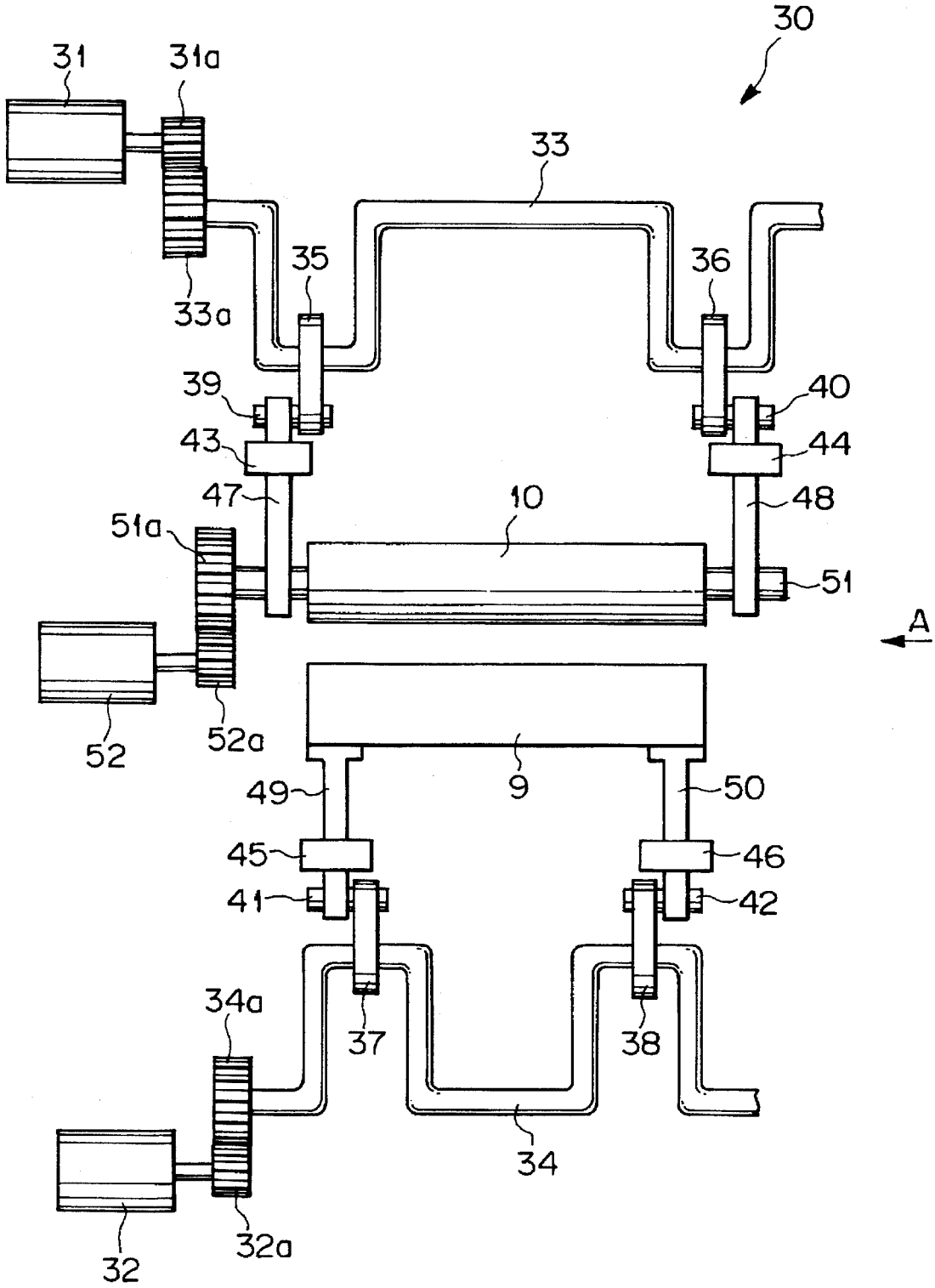
FIG. 16 is a front view of moving means included in the fifth embodiment.
Figure 17:
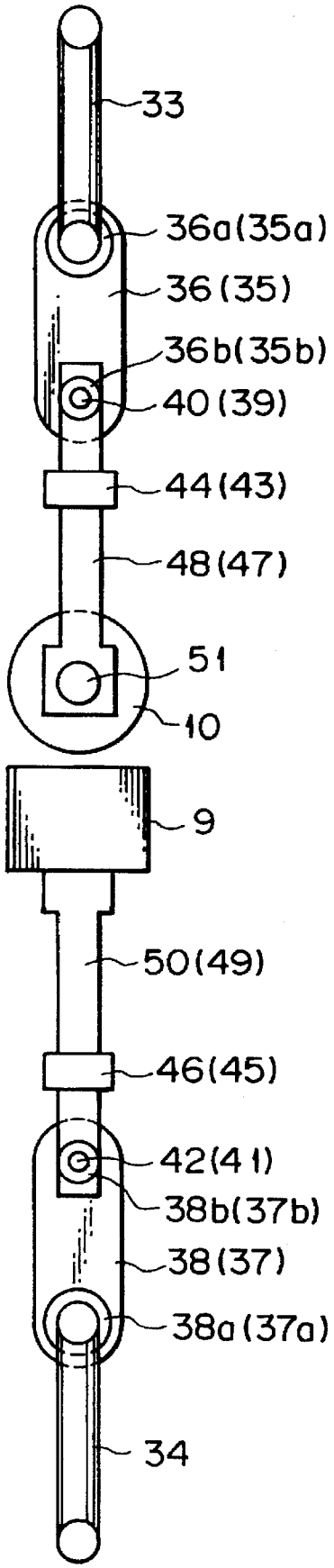
FIG. 17 is a side elevation of the moving means.

As shown in FIGS. 16 and 17, the moving means 30 includes a motor 31 for moving the platen roller 10, a motor 32 for moving the head 9, crank shafts 33 and 34, sliders 35, 36, 37 and 38, connecting pins 39, 40, 41 and 42, slider guides 43, 44, 45 and 46, and arms 47, 48, 49 and 50. The motors 31 and 32 are mounted on the housing 7. Gears 31*a* and 32*a* are respectively mounted on the output shafts of the motors 31 and 32. The crank shafts 33 and 34 have generally the same configuration including two U-shaped bends. However, the distance between the two bends is slightly greater in the crank shaft 33 than in the crank shaft 34. Gears 33*a* and 34*a* are respectively mounted on one end of the crank shafts 33 and 34. The gears 33*a* and 34*a* are held in mesh with the gears 31*a* and 32*a*, respectively. The sliders 35 and 36 are respectively rotatably engaged at one end with the bends of the crank shaft 33 via bearings 35*a* and 36*a*. Likewise, the sliders 37 and 38 are respectively rotatably engaged at one end with the bends of the crank shaft 34 via bearings 37*a* and 38*a*. The other ends of the sliders 35–38 are respectively rotatably engaged with the arms 47–50 by the pins 39–42 via bearings 35*b*, 36*b*, 37*b* and 38*b*. The slider guides 43–46, each having a generally U-shaped configuration, are mounted on the housing 7 in such a manner as to straddle the associated arms 47–50. The platen roller 10 is mounted on a shaft 51 which is loosely fitted in the ends of the arms 47 and 48 remote from the pins 39 and 40. The head 9 is mounted on the ends of the arms 49 and 50 remote from the pins 41 and 42.

In the above construction, when the motors 31 and 32 are driven at the same time as and in synchronism with each other, the head 9 and platen roller 10 are selectively moved to their fifth position or sixth position. A gear 51*a* is mounted on one end of the shaft 51. A gear 52*a* is mounted on the output shaft of a stepping motor 52 which is mounted on the housing 7 for driving the platen roller 10. When the platen roller 10 is moved to the sixth position, the gear 51*a* is brought into mesh with the gear 52*a*.

Figure 18:
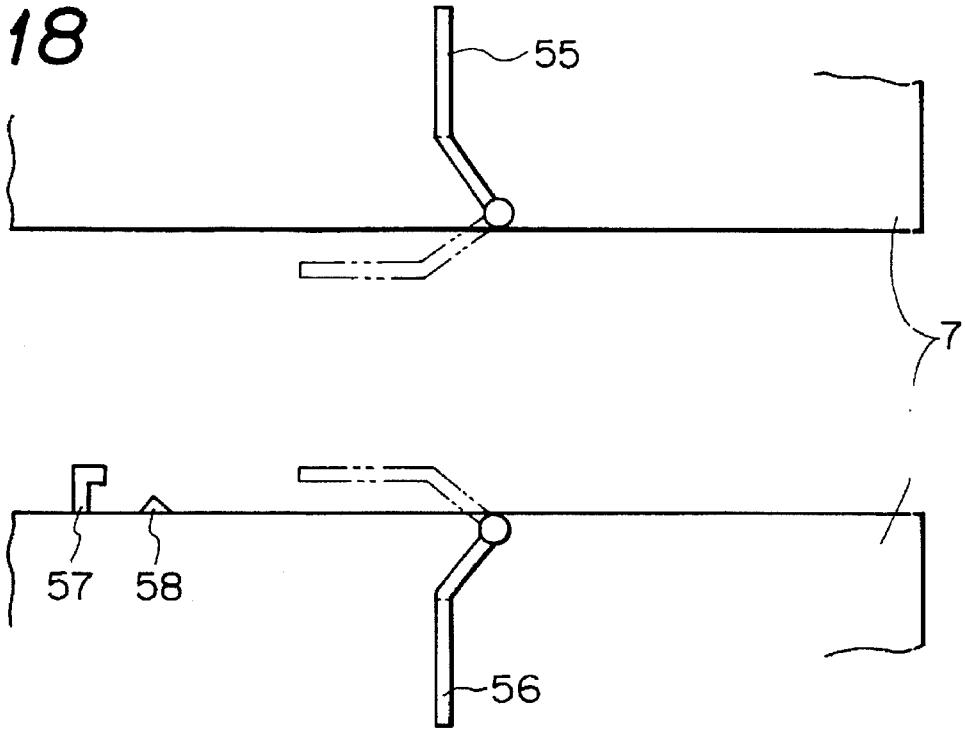
FIG. 18 is a side elevation also representing the operation of the fifth embodiment.

As shown in FIG. 18, arms 55 and 56, a stop 57 and a switch 58 are mounted on the housing 7. The arms 55 and 56 open and close the lids 22 and 21, respectively. The stop 57 plays the role of means for positioning the stencil unit 8 in the housing 7. The switch 58 causes, on sensing the stencil unit 8, the various mechanisms to start operating. Specifically, the stop 57 positions the stencil unit 8 at a predetermined position.

Figure 19:
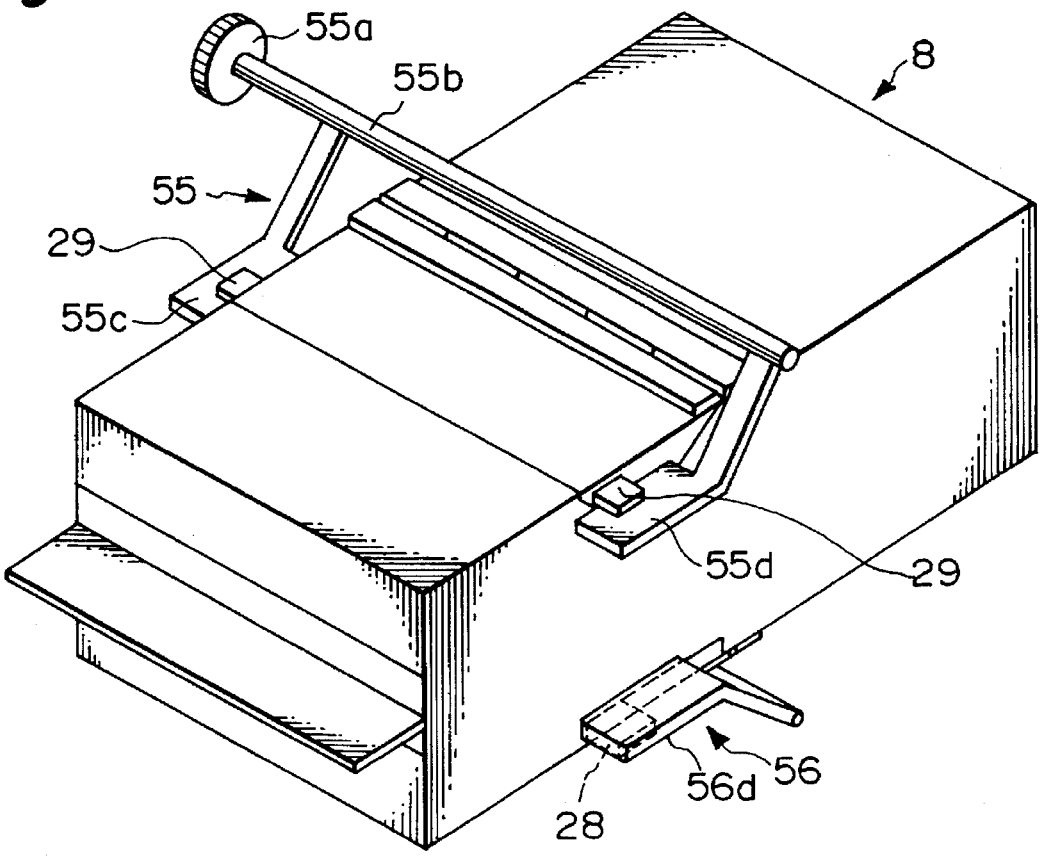
FIGS. 19 and 20 are respectively a perspective view and a front view of the stencil unit and arms included in the fifth embodiment.
Figure 20:
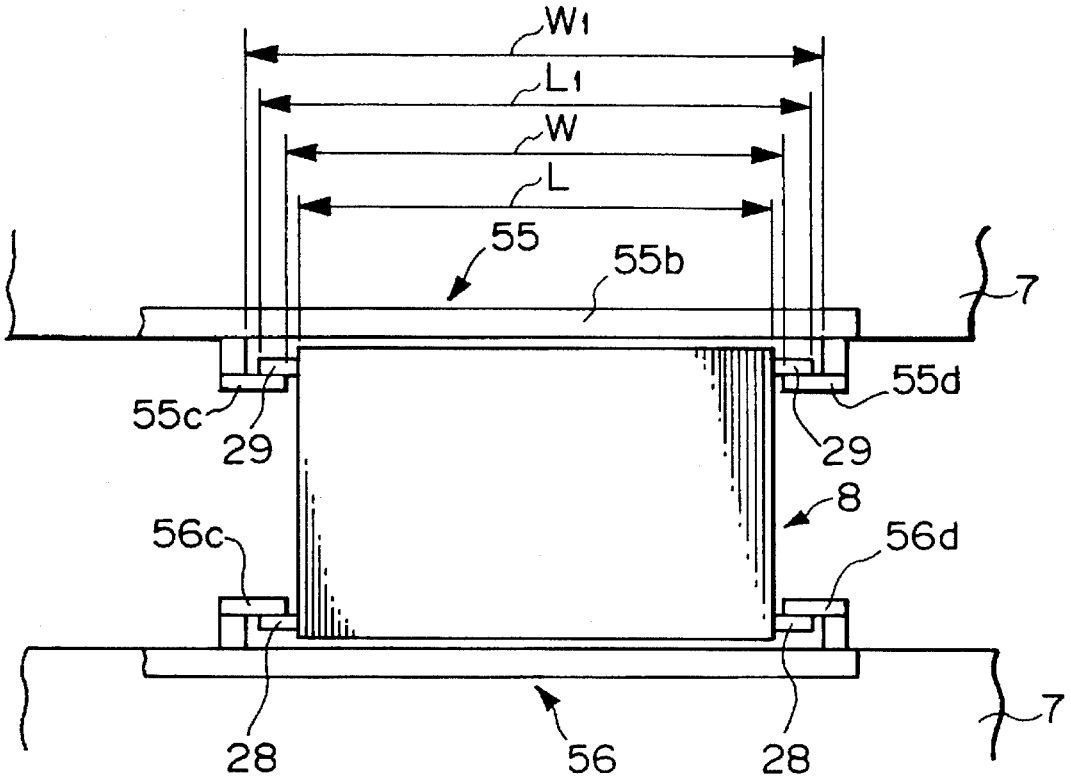

As shown in FIGS. 19 and 20, the arm 55 is made up of a shaft 55*b* and two arm members 55*c* and 55*d* which are affixed to the shaft 55*b* at a predetermined spacing from each other. The arm members 55*c* and 55*d* are symmetrical to each other in configuration. A gear 55*a* is mounted on one end of the shaft 55*b*. The shaft 55*b* is journalled to the housing 7 and rotated by a stepping motor, not shown. The arm members 55*c* and 55*d* are each slowly bent at substantially the intermediate portion thereof. Part of each arm member 55*c* or 55*d* extending between the bent portion and the end affixed to the shaft 55*b* is notched to have a reduced width. The width W between the inner edges of the arms 55*c* and 55*d* is slightly greater than the width L of the stencil unit 8. Also, the width W1 between the inner edges of the notched portions is slightly greater than the width L1 between the outer edges of the lugs 29 of the lid 22. The arm 56 is configured symmetrically to the arm 55 and driven by a stepping motor, not shown.

The stop 57 is mounted on the housing 7 and positions the stencil unit 8 at a predetermined position. As a result, the holes 24 and 25 of the cover 20 are positioned. In this condition, the head 9 and platen roller 10 can be moved into and out of the stencil unit 8. When the stencil unit 8 presses the switch 58, a motor, not shown, is driven to rotate the arms 55 and 56 in response to the output of the switch 58. Subsequently, the head 9 and platen roller 10 are moved by the moving means 30.

A conveyor roller pair 12 is located at the rear of the stop 57 and rotatably supported by the housing 7. Drive means, not shown, rotates the conveyor roller pair 12 in synchronism with the conveyor roller pair 13, thereby conveying the stencil 17*a* toward the print section 4.

Figure 21:
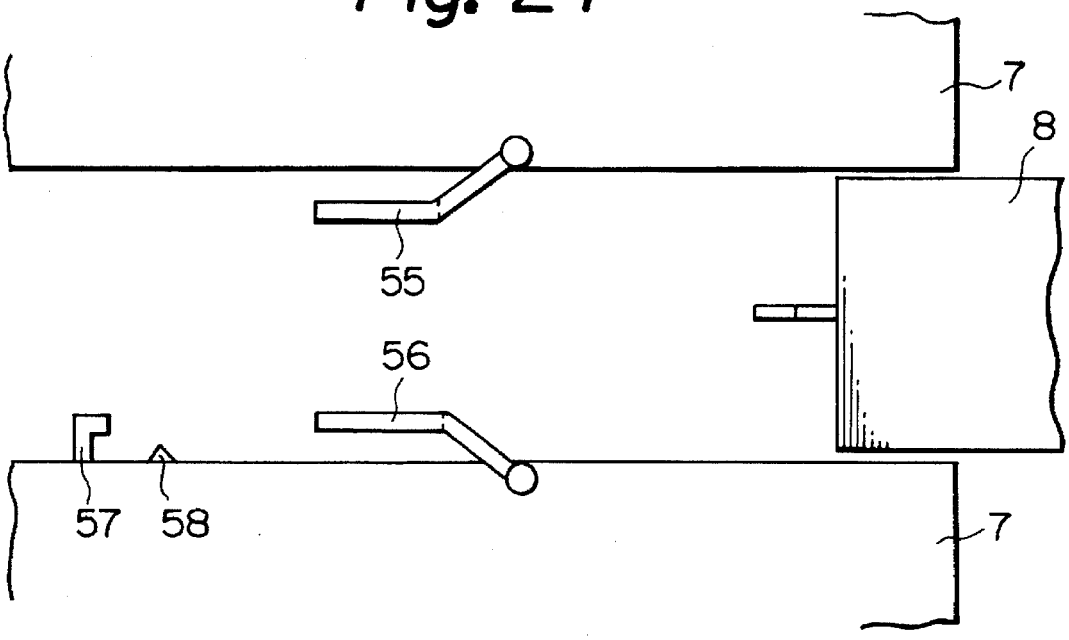
FIGS. 21–25 are side elevations also demonstrating the operation of the fifth embodiment.
Figure 22:
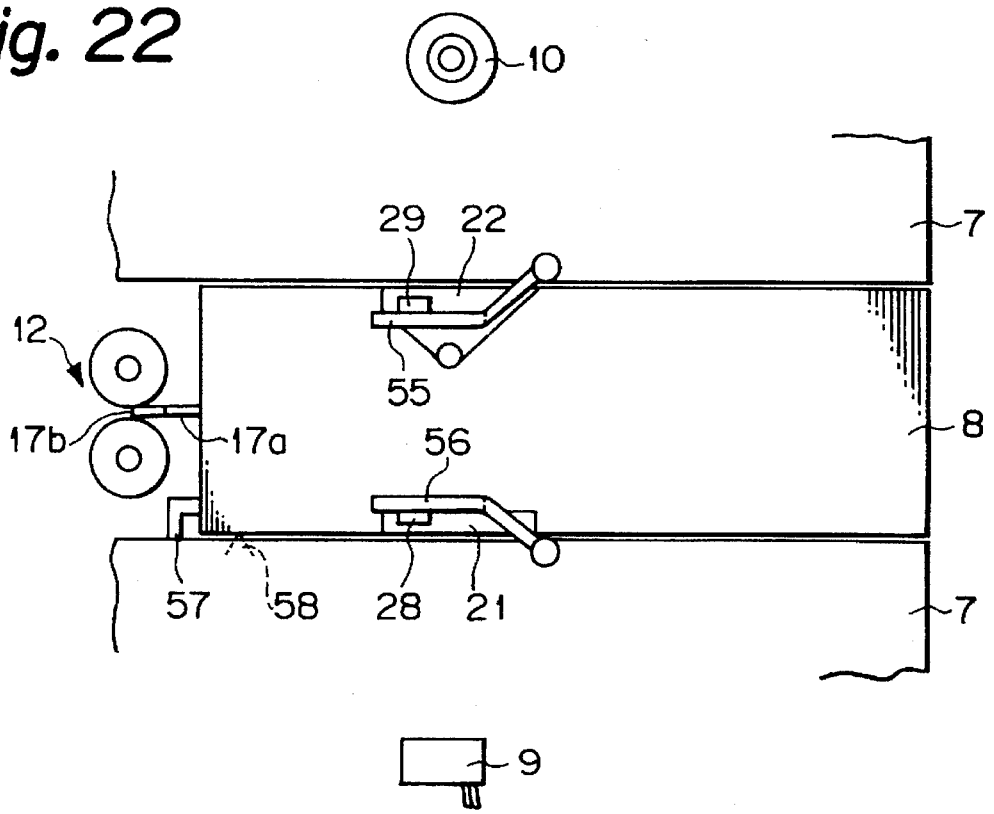

The operation of the illustrative embodiment is as follows. To begin with, the stencil unit 8 with the stencil roll 17 (see FIGS. 10 and 12) is inserted into the housing 7. In such an initial condition, the arms 55 and 56 are positioned such that their arm members 55*c* and 56*c* and arm members 55*d* and 56*d* are parallel to each other (see FIGS. 20 and 21). As the stencil unit 8 is inserted deeper into the housing 7, the lugs 28 and 29 of the lids 21 and 22 are respectively brought onto the arm members 55*c* and 55*d* and the arm members 56*c* and 56*d* of the arms 55 and 56 via the space between the arm members (see FIGS. 19 and 20). Finally, the stencil unit 8 is positioned on abutting against the stop 57. At this instant, the tab 17*b* of the stencil 17*a* (see FIG. 10), protruding from the guide portion 19 of the stencil unit 8, is nipped by the conveyor roller pair 12, and the unit 8 presses the switch 58. At this time, the head 9 and platen roller 10 are still spaced apart from the stencil unit 8 (see FIG. 22).

Figure 23:
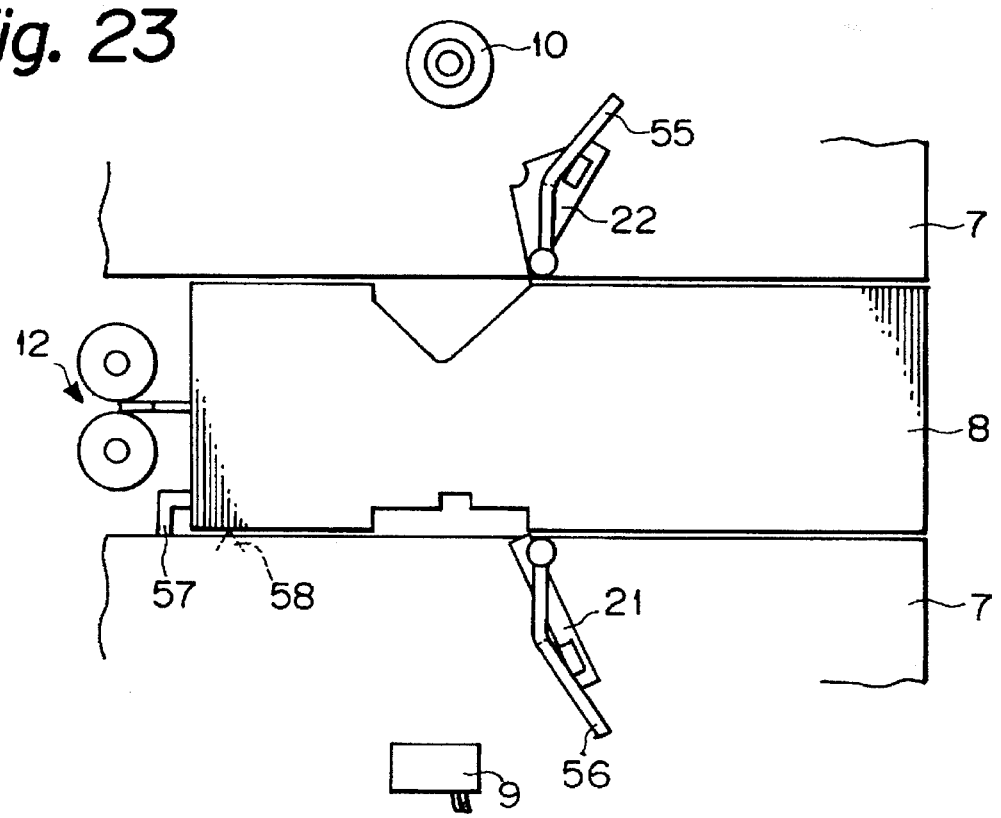

In response to the output of the switch 58, the control means drives the stepping motors respectively assigned to the arms 55 and 56. These stepping motors each rotate the respective arm 55 or 56 in the direction in which the associated lid 22 or 21 opens. On determining that the lids 22 and 21 are each opened a predetermined angle on the basis of the number of steps, the control means stops driving the stepping motors (see FIG. 23).

Figure 24:
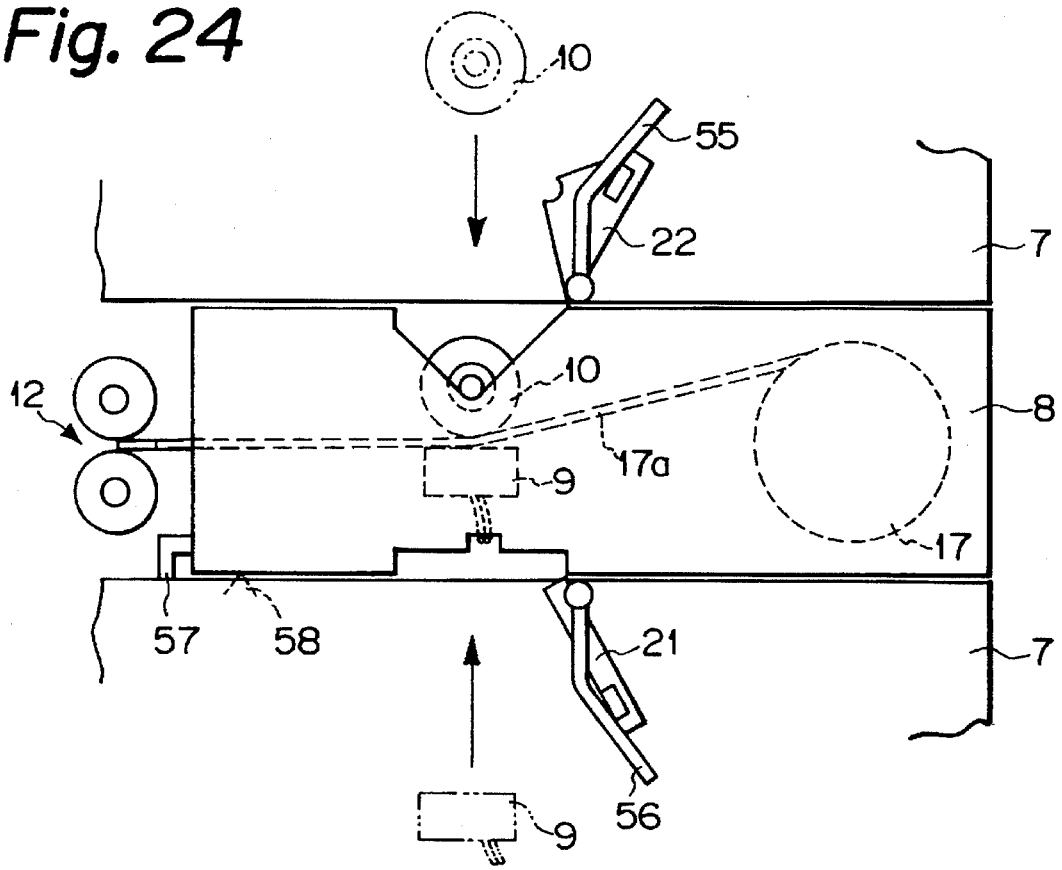
Figure 25:
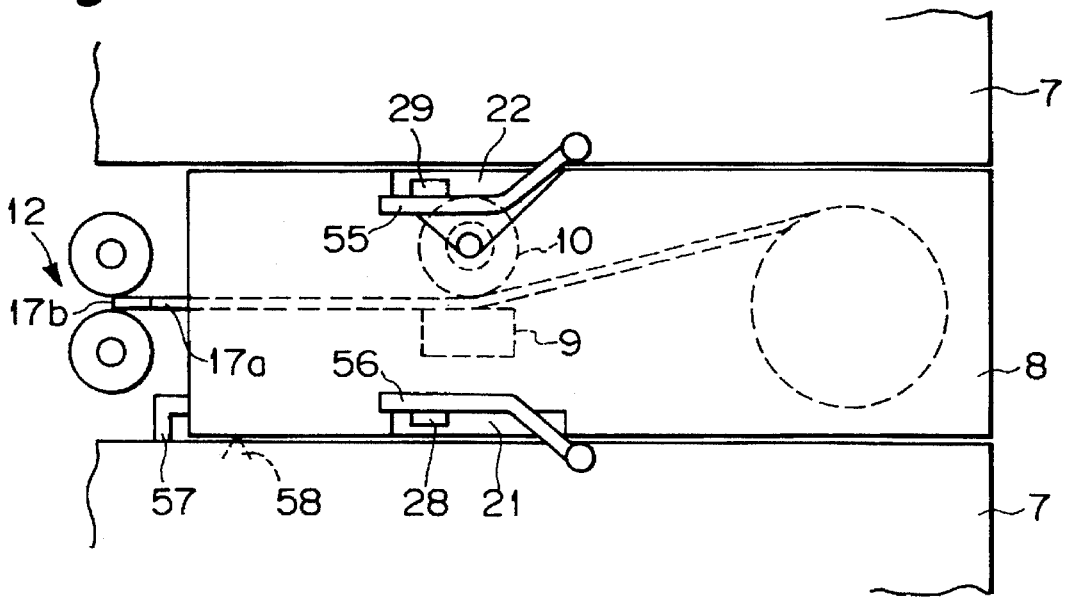

Subsequently, the control means drives the motors 31 and 32, FIG. 16, associated with the platen roller 10 and head 9, respectively. As a result, the head 9 and platen roller 10 are each moved from the fifth position (dash-and-dots line, FIG. 24) to the sixth position (dashed line, FIG. 24), as indicated by an arrow in the figure. Specifically, the head 9 and platen roller 10 are moved toward each other to the sixth position where they nip the stencil 17*a*. Then, the control means drives each of the stepping motors assigned to the arms 55 and 56 in the opposite direction, i.e., in the direction in which the lid 22 or 21 closes. The lids 22 and 21 are rotated in the closing direction by the torsion springs which are respectively associated with the hinges 27 and 26. On determining that the lids 22 and 21 are closed on the basis of the number of steps, the control means stops driving the stepping motors (see FIG. 25). In this condition, the stencil 17*a* is conveyed by the platen roller 10 and conveyor roller pair 12. Subsequently, the cutter 11 cuts off the tab 17*b* heading the stencil 17*a*. By such a procedure, the stencil unit 8 is fully set on the printer 1 (see FIG. 9).

After the stencil unit 8 has been set on the printer 1, the printer 1 starts on a master discharging operation. To begin with, the drum drive means 67 rotates the drum 66, carrying the previous or used master thereon, until the trailing edge of the master faces the roller 83, i.e., the master discharge position. Then, the rotating means, not shown, angularly moves the roller 83 to a position where it abuts against the master wound round the drum 66. Subsequently, the drive means, not shown, rotates the roller 83 counterclockwise as viewed in FIG. 9, while the drum drive means 67 rotates the drum 66 counterclockwise. As a result, the used master is separated from the drum 66 and driven into the waste box 84 by the rollers 82 and 83. This is followed by a master making operation, as follows.

After the drum drive means 67 has located the drum 66 at a master making position shown in FIG. 9, the opening and closing means, not shown, opens the clamper 71 to the position also shown in FIG. 9. After a document image has been read, the control means causes the platen roller 10 and conveyor roller pairs 12 and 13 to start rotating at the same time in synchronism with each other. While the platen roller 10 and conveyor roller pair 12 convey the stencil 17*a*, the head 9 perforates it by heat in accordance with image data representative of the document image. The perforated stencil, or master, 17*a* is stretched by the guide portion 19. The leading edge portion of the master 17*a* is conveyed by the conveyor roller pair 13 along the guides 14 and 15 and then along the guide 16 toward the clamper 71. The control means determines whether or not the leading edge portion of the master 17*a* has reached the clamper 71 on the basis of the number of steps of the stepping motor 52, FIG. 16. When the leading edge portion of the master 17*a* has reached the clamper 71, the control means causes the clamper 71 to close. As a result, the leading edge portion of the master 17*a* is retained on the drum 66 by the clamper 71. The drum drive means 67 rotates the drum 66 clockwise, as viewed in FIG. 9, while the platen roller 10 and conveyor rollers 12 and 13 are rotated in synchronism with the drum 66. Consequently, the master 17*a* is wrapped around the drum 66. On determining that the master 17*a* has been conveyed a predetermined distance on the basis of the number of steps of the stepping motor, the control means causes the drum 66, platen roller 10 and conveyor roller pairs 12 and 13 to stop rotating. After the cutter 11 has cut off the master 17*a*, the drum 66 is rotated to wrap it therearound. This is the end of the master making procedure.

Subsequently, the pick-up roller 60 feeds the uppermost sheet 65 from the tray 59 toward the registration roller pair 62. The registration roller pair 62 drives, at a predetermined timing, the sheet 65 to between the drum 66 and the presser 69. Then, the presser 69 is angularly moved by the moving means until it abuts against the drum 66 via the sheet 65. As a result, ink fed from the ink supply means 68 deposits on the sheet 65 via the pores of the drum 66 and the perforated portions of the master 17*a*, whereby the image transferred to the sheet 65. The sheet 65 with the image, i.e., a printing 98 is separated from the drum 66 by the separator 74 and driven toward the conveyor 76 along the guide 75. The conveyor 76 conveys the printing 98 while sucking it onto the belt 80 with the fan 81 and drives it out of the housing 7 onto the tray 77. If the image produced by such a trial printing is acceptable, the same image are sequentially printed on the second and successive sheets 65.

After the printing operation, the stencil unit 8 is removed from the printer 1, as follows. To begin with, the operator presses a "Unit Remove" button provided on the operation panel. In response, the control means drives the motors respectively assigned to the moving means 30 and arms 55 and 56 in the opposite direction such that the conditions shown in FIGS. 25, 24, 23 and 22 sequentially occur in this order.

Figure 26:
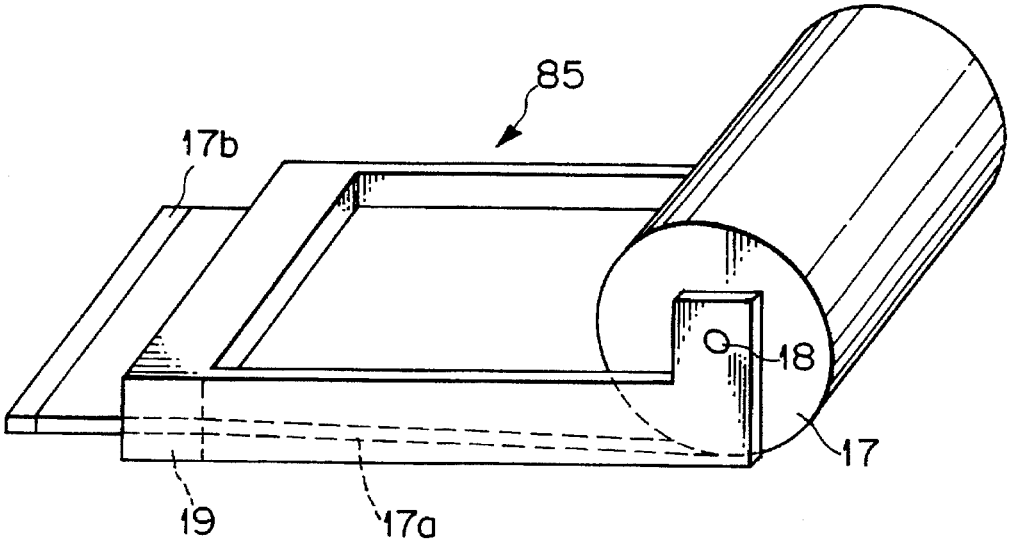
FIGS. 26 and 27 are perspective views representative of a modification of the fifth embodiment.

If desired, the stencil unit 8 may be replaced with the unit body 53, FIG. 11, lacking the cover 20. Then, the arms 55 and 56 and drive means therefor are omissible, so that the apparatus is simplified. FIG. 26 shows a stencil unit 85 having another specific configuration. The top and bottom of the stencil unit 85 each has a particular configuration, preventing an ordinary stencil having a laminate structure from being mounted inside out. When use is made of the unit body 53 whose top and bottom are identical in configuration, a stencil implemented substantially only by a thermoplastic resin film can be mounted without regard to the top-and-bottom position.

Figure 27:
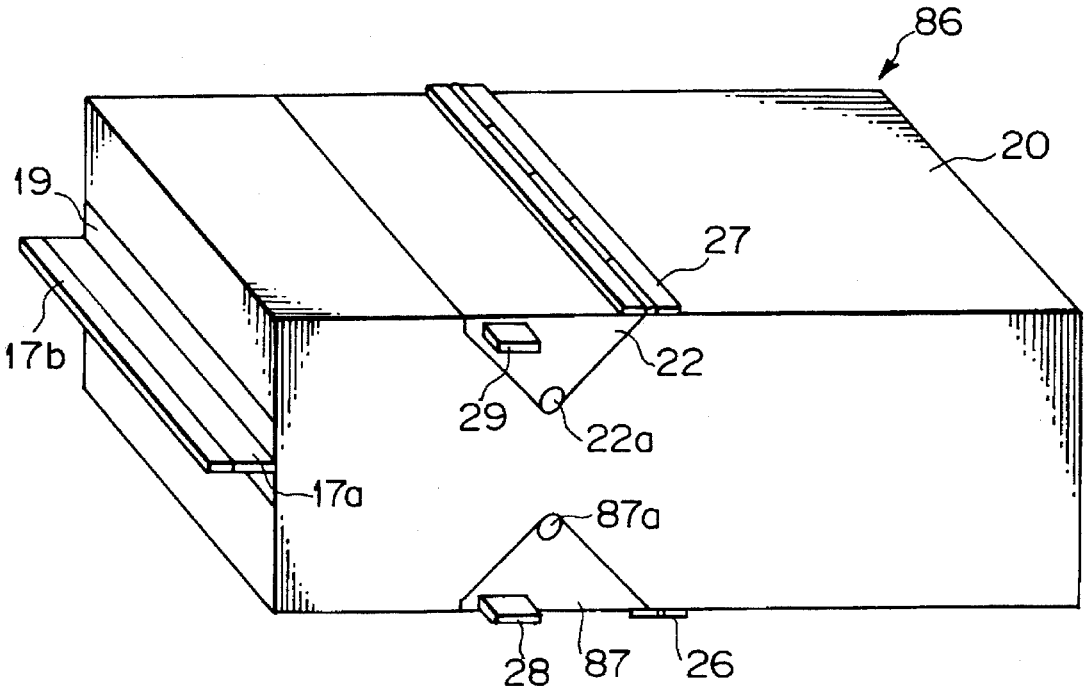

FIG. 27 shows a stencil unit 86 which is a modified form of the stencil unit 8. As shown, the stencil unit 86 differs form the stencil unit 8 in that it has a lid 87 and a hole 87*a* in place of the lid 21 and hole 21*a*. The lid 87 and hole 87*a* are symmetric to the lid 22 and hole 22*a*. When a stencil implemented substantially only by a thermoplastic resin film is set on the stencil unit 86, the unit 86 can be mounted without regard to the top-and-bottom position, as when the unit body 53 is used in the above-described modification.

Figure 28:
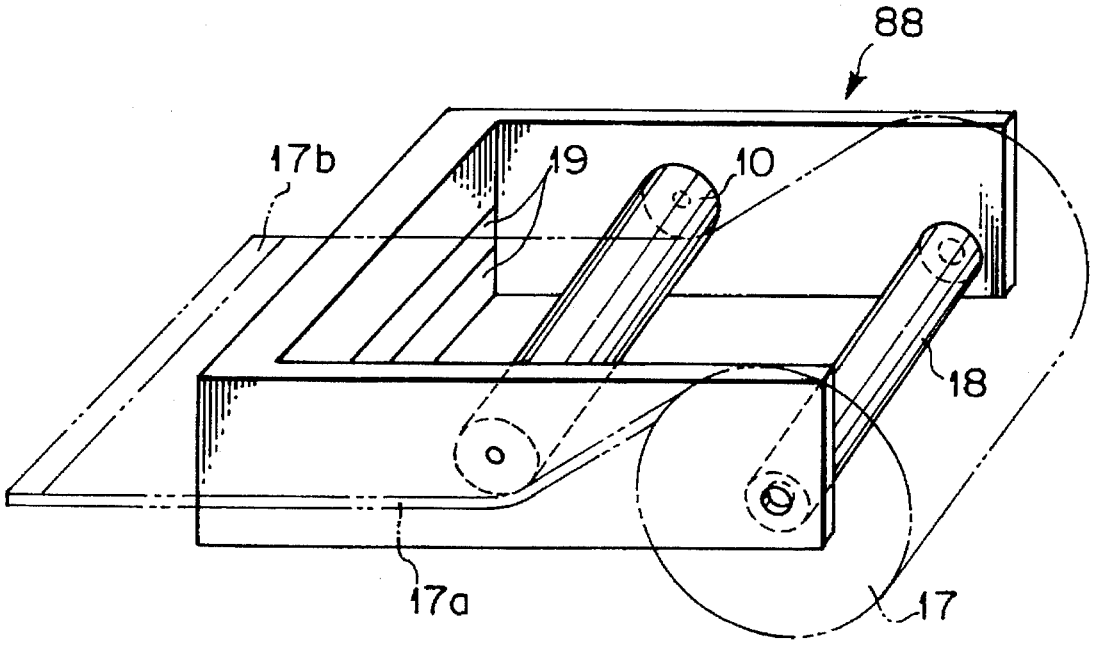
FIG. 28 is a perspective view representative of another modification of the fifth embodiment.
Figure 29:
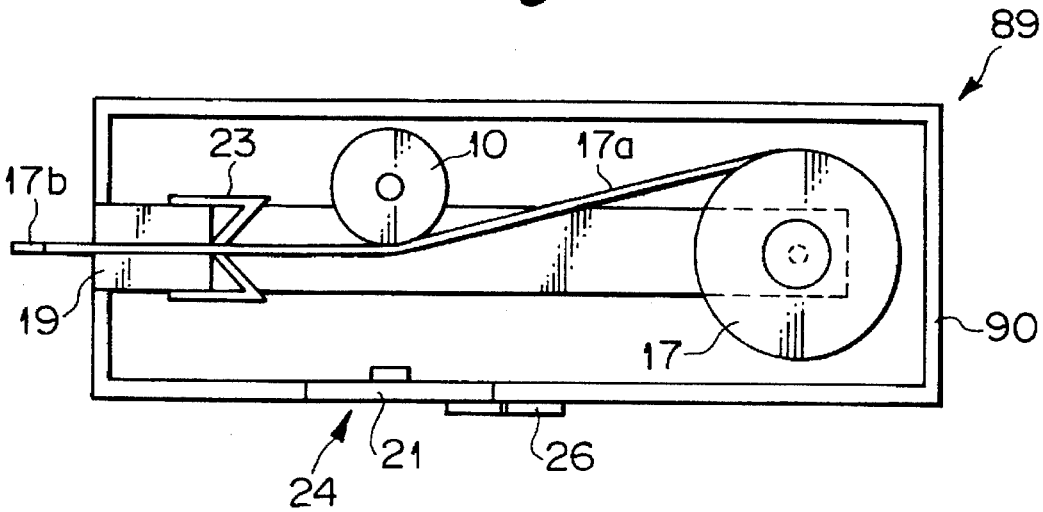
FIG. 29 is a sectional side elevation showing still another modification of the fifth embodiment.

FIGS. 28 and 29 respectively show stencil units 88 and 89 which are further modifications of the stencil unit 8. As shown, the stencil unit 88 differs from the unit body 53 in that it has the platen roller 10 thereinside. This makes it needless to provide the printer 1 with means for moving the platen roller 10 and, therefore, simplifies the moving means 30. The stencil unit 89 is different from the stencil unit 8 in that it has the platen roller 10 thereinside, and in that it has a cover 90 lacking the lid 22 and opening 25. Hence, the stencil unit 89 also simplifies the moving means 30 and, in addition, implements the cover 90 at lower cost than the cover 20.

Again, the words "stencil implemented substantially only by a thermoplastic resin film" refer to a stencil consisting only of a thermoplastic resin film, a stencil in the form of a thermoplastic resin film containing a small amount of anti-static agent or similar substance, or a stencil having one or more overcoat layers or similar thin films on at least one of opposite major surfaces of a thermoplastic resin film.

In summary, it will be seen that the present invention has various unprecedented advantages, as enumerated below.

(1) The operator does not have to mount a stencil roll to a stencil unit and need only mount the whole stencil unit, containing the roll, to a stencil printer. This reduces the chance that the operator touches the stencil and, therefore, protects the stencil from creases, thereby promoting a sure master making procedure. In addition, even an inexperienced person can mount the roll to the printer easily.

(2) Since the stencil unit is mounted to the printer with the leading edge portion of the stencil protruding a predetermined distance therefrom, the manipulation for causing perforating means to nip the leading edge portion is facilitated.

(3) A pair of pay-out rollers nip the leading edge of the stencil. Hence, the leading edge portion of the stencil can be nipped at a position close to a stencil unit mounting position and, therefore, the stencil need only protrude a minimum of distance from the stencil unit.

(4) The stencil is prevented from noticeably slackening between the leading edge thereof and the roll and, therefore, from creasing during master making operation.

(5) The leading edge portion of the stencil is prevented from retracting into the stencil unit or protruding from the unit more than required.

(6) It is not necessary for the operator to pull out the leading edge portion of the stencil from the stencil unit beforehand.

(7) The leading edge portion of the stencil is smoothly conveyed to the outside of the stencil unit without suffering from creases.

(8) Even an inexperienced person can mount and dismount the stencil unit from a stencil printer easily.

(9) In the event of printing, a minimum of dust, including paper dust, is allowed to deposit on the stencil, so that a master can be reliably made. Further, during storage, such stencil units prevent dust from depositing on their stencils and can even be stacked one upon the other.

(10) Even when the stencil is implemented substantially only by a thermoplastic resin film, the stencil unit can be mounted to the stencil printer without regard to the inside-and-outside position. This eliminates the misorientation of the stencil unit in the printer and allows anybody to set the former on the latter with ease.

(11) There can be obviated an occurrence that the stencil slackens within the stencil unit due to the retraction thereof into the unit, and an occurrence that the leading edge portion of the stencil slips out of a guide member. Hence, the stencil can be surely conveyed toward the perforating means.

(12) Both the stencil printer and the stencil unit are simple in configuration and inexpensive.

Various modifications will become possible for those skilled in the art after receiving the teachings of the present disclosure without departing from the scope thereof.

What is claimed is:

1. A stencil unit for a master making apparatus, comprising:

a stencil wound into a roll and having a winding axis;

a box-like holder portion for holding said roll, said holder portion having an inner surface, said inner surface having a first region and a second region, said stencil inside said box-like holder portion; and a guide portion having surfaces defining a slot in said stencil unit, said guide portion for retaining a leading edge portion of said stencil paid out a predetermined length from said roll and for guiding said stencil through said slot and along a direction perpendicular to said winding axis as said stencil is paid out; and wherein said guide portion comprises at least one leaf spring for pressing said leading edge portion against the first region of the inner surface of said holder portion, said at least one leaf spring is connected to the second region of the inner surface and said at least one leaf spring retains the leading edge portion of said stencil by pressing said leading edge portion against the first region of the inner surface of said holder portion when said stencil is being paid out.

2. A stencil unit as claimed in claim 1, further comprising a braking member for braking rotational movement of said roll.

3. A stencil unit as claimed in claim 1, further comprising means for removably mounting said stencil unit to the master making apparatus.

4. A master making apparatus comprising:

a stencil wound into a roll, said stencil having a leading edge portion;

perforating means for perforating said stencil paid out from said roll by heat in accordance with image data;

cutting means for cutting said stencil perforated by said perforating means at a predetermined length;

a stencil unit housing said stencil;

mounting means for removably mounting said stencil unit to said master making apparatus;

wherein said stencil unit comprises a box-like holder portion holding said roll and having an inner surface a guide portion having surfaces defining a slot, at least one leaf spring, said guide portion comprises means for guiding said stencil as said stencil is paid out from said roll and for pressing the leading edge portion against the inner surface of said holder portion as said stencil is being paid out from said roll.

5. An apparatus as claimed in claim 4, wherein said perforating means comprises a thermal head for perforating said stencil paid out from said roll by heat and a platen roller pressing said stencil against said thermal head.

6. An apparatus as claimed in claim 5, further comprising moving means for selectively moving at least one of said thermal head and said platen roller to a first position where said thermal head and said platen roller contact each other or to a second position where said thermal head and said platen roller are spaced apart from each other.

7. An apparatus as claimed in claim 6, wherein said mounting means comprises a guide portion for guiding said stencil unit; and further comprising a pay out roller unit for paying out the roll such that said leading edge portion of said stencil is brought to a gap between said thermal head and said platen roller when said thermal head and said platen roller are in said second position.

8. An apparatus as claimed in claim 4, further comprising a pair of pay-out rollers intervening between said mounting means and said perforating means, and roller moving means for selectively moving at least one of said pay-out rollers to a first position where said rollers contact each other or to a second position where said rollers are spaced apart from each other.

9. An apparatus as claimed in claim 8, wherein said mounting means comprises a guide portion for guiding said stencil unit; and wherein said leading edge portion of said stencil is brought to a gap between said pair of pay-out rollers moved to said second position by said roller moving means.

10. A master making apparatus, comprising:

a master making apparatus frame;

a stencil unit;

means for removably mounting said stencil unit to said frame;

said stencil unit is mounted to said master making apparatus frame;

wherein said stencil unit comprises a box-lime holder portion holding a stencil in a form of a roll and a guide portion formed integrally with said holder portion, said guide portion nipping a leading edge of said stencil paid out from said roll and guiding said leading edge portion of said stencil;

wherein said guide portion comprises at least one leaf spring which presses said leading edge portion against an inner surface of said holder portion when said stencil is being paid out;

a thermal head for perforating said stencil paid out from said roll by heat in accordance with image data;

a platen roller pressing said stencil against said thermal head; and cutting means for cutting said stencil at a predetermined length.

11. A box-like stencil unit for a master making apparatus, said stencil unit comprising:

a stencil which is wound into a roll about a winding axis;

a holder portion holding said roll; and a guide portion having opposing surfaces that are separated by a leading edge portion of said stencil and defining a slot in said box-like stencil unit; and wherein said box-like stencil unit comprises means for biasing said opposing surfaces of said guide portion towards one another;

wherein said guide portion comprises means for retaining said leading edge portion of said stencil paid between said opposing surfaces and means for guiding said stencil through said slot and along a direction perpendicular to said winding axis as said stencil is paid out.

12. A box-like stencil unit structured so that it may be structurally interrelated with a master making apparatus, said stencil unit comprising:

a stencil which is wound into a roll about a winding axis;

a holder portion holding said roll; and a guide portion having opposing surfaces that press towards one another;

wherein said box-like stencil unit comprises means for biasing said opposing surfaces towards one another;

wherein a leading edge portion of said stencil is between said opposing surfaces of said guide portion so that said opposing surfaces press against said leading edge portion and hold said leading edge portion in place; and wherein said guide portion defines a slot in said box-like stencil unit and functions to guide said stencil through said slot and along a direction perpendicular to said winding axis when said stencil is paid out.

13. A stencil unit for a master making apparatus, comprising:

a stencil which is wound into a roll, said roll having a winding axis;

a holder portion holding said roll; and a guide portion having a slot in said stencil unit, said guide portion comprising means for retaining a leading edge portion of said stencil protruding a predetermined length from said stencil unit and for guiding said stencil through said slot and along a direction perpendicular to said axis as said stencil is paid out.

14. A master making apparatus comprising:

a stencil wound into a roll;

perforating means for perforating said stencil paid out from said roll by heat in accordance with image data;

cutting means for cutting said stencil perforated by said perforating means at a predetermined length;

a stencil unit housing said stencil; and mounting means for removably mounting said stencil unit to said master making apparatus;

wherein said stencil unit comprises a holder portion holding said roll and a guide portion having a slot, said guide portion comprising a spring for retaining a leading edge portion of said stencil protruding a predetermined length from said stencil unit, said guide portion comprising means for guiding said stencil through said slot as said stencil is paid out from said roll.

15. A master making apparatus as claimed in claim 14, wherein said perforating means comprises a thermal head for perforating said stencil paid out from said roll by heat and a platen roller for pressing said stencil against said thermal head, and wherein said mounting means comprises a guide portion for guiding said stencil unit; and further comprising moving means for selectively moving at least one of said thermal head and said platen roller to a first position where said thermal head and said platen roller contact each other or to a second position where said thermal head and said platen roller are spaced apart from each other and a pay-out roller unit for paying out the roll such that said leading edge portion of said stencil is brought to a gap between said thermal head and said platen roller when said thermal head and said platen roller are in said second position.

16. A master making apparatus as claimed in claim 14, further comprising a pair of pay-out rollers intervening between said mounting means and said perforating means, and roller moving means for selectively moving at least one of said pay-out rollers to a first position where said rollers contact each other or to a second position where said rollers are spaced apart from each other.

17. A master making apparatus as claimed in claim 16, wherein said mounting means comprises a guide portion for guiding said stencil unit; and wherein said leading edge portion of said stencil is brought to a gap between said pair of pay-out rollers moved to said second position by said roller moving means.

18. A master making apparatus, comprising:

a stencil unit;

a master making apparatus frame;

means for removably mounting said stencil unit to said frame;

said stencil unit removably mounted to said master making apparatus frame and comprising a holder portion holding a stencil in a form of a roll and a guide portion formed integrally with said holder portion, said guide portion comprising a spring for retaining a leading edge portion of said stencil protruding a predetermined length from said stencil unit and for guiding said stencil as said stencil is paid out from said roll;

a thermal head for perforating said stencil paid out from said roll by heat in accordance with image data;

a platen roller pressing said stencil against said thermal head; and cutting means for cutting said stencil at a predetermined length.

19. A stencil unit for a master making apparatus, comprising:

a stencil which is wound into a roll, said roll having a winding axis;

a holder portion for holding said roll; and a guide portion having a slot in said stencil unit, said guide portion comprising means for retaining a leading edge portion of said stencil and for guiding said stencil through said slot and along a direction perpendicular to said axis as said stencil is being paid out.

20. A master making apparatus comprising:

a stencil wound into a roll;

perforating means for perforating said stencil paid out from said roll by heat in accordance with image data;

cutting means for cutting said stencil perforated by said perforating means at a predetermined length;

a stencil unit housing said stencil;

and means for removably mounting said stencil unit to said master making apparatus;

wherein said stencil unit comprises a holder portion holding said roll and a guide portion having a slot and comprising a spring for guiding and retaining a leading edge portion of said stencil, as said stencil is being paid out from said roll.

21. A master making apparatus as claimed in claim 20, wherein said perforating means comprises a thermal head for perforating said stencil paid out from said roll by heat and a platen roller for pressing said stencil against said thermal head, and wherein said mounting means comprises a guide portion for guiding said stencil unit; and further comprising moving means for selectively moving at least one of said thermal head and said platen roller to a first position where said thermal head and said platen roller contact each other or to a second position where said thermal head and said platen roller are spaced apart from each other and a pay-out roller unit for paying out the roll such that said leading edge portion of said stencil is brought to a gap between said thermal head and said platen roller when said thermal head and said platen roller are in said second position.

22. A master making apparatus as claimed in claim 20, further comprising:

a pair of pay-out rollers intervening between said mounting means and said perforating means and roller moving means for selectively moving at least one of said pay-out rollers to a first position where said rollers contact each other or to a second position where said rollers are spaced apart from each other.

23. A master making apparatus as claimed in claim 22, wherein said mounting means comprises a guide portion for guiding said stencil unit; and wherein said leading edge portion of said stencil is brought to a gap between said pair of pay-out rollers moved to said second position by said roller moving means.

24. A master making apparatus, comprising:

a master making apparatus frame;

a stencil unit;

means for removably mounting said stencil unit to said frame;

said stencil unit removably mounted to said master making apparatus frame and comprising a holder portion holding a stencil in a form of a roll and a guide portion formed integrally with said holder portion, said guide portion including a spring for nipping a leading edge portion of said stencil as said stencil is being paid out from said roll and for guiding said stencil as said stencil is being paid out from said roll;

a thermal head for perforating said stencil paid out from said roll by heat in accordance with image data;

a platen roller pressing said stencil against said thermal head; and cutting means for cutting said stencil at a predetermined length.

* * * * *

UNITED STATES PATENT AND TRADEMARK OFFICE

CERTIFICATE OF CORRECTION

PATENT NO. : 5,640,904

DATED : June 24, 1997

INVENTOR(S) : Mitsuo SATO et al.

It is certified that error appears in the above-identified patent and that said Letters Patent is hereby corrected as shown below:

In column 4, line 22, change "polyethyene" to --polyethylene--.

In column 6, line 60, change "spring 96" to --spring 96.--

In column 8, line 30, change "17a" to --117a--.

In column 10, line 4, change "dosed" to --closed--.

In column 11, line 33, change "polyethyene" to --polyethylene--.

In column 12, line 59, change "polyethyrene" to --polyethylene--.

In column 15, lines 42-43, change "A spring, shown, is yieldably accommodated in the holder not" to --A spring, not shown is yieldably accommodated in the holder--.

UNITED STATES PATENT AND TRADEMARK OFFICE

CERTIFICATE OF CORRECTION

PATENT NO. : 5,640,904

DATED : June 24, 1997

INVENTOR(S) : Mitsuo SATO et al.

It is certified that error appears in the above-identified patent and that said Letters Patent is hereby corrected as shown below:

In column 19, line 40, change "form" to --from--.

Signed and Sealed this

Seventeenth Day of March, 1998

*Attest:*

*Attesting Officer*

BRUCE LEHMAN

*Commissioner of Patents and Trademarks*